US006714176B2

(12) United States Patent
Yamamoto et al.

(10) Patent No.: US 6,714,176 B2
(45) Date of Patent: Mar. 30, 2004

(54) PLASMA DISPLAY DEVICE AND A METHOD OF DRIVING THE SAME

(75) Inventors: Kenichi Yamamoto, Higashimurayama (JP); Keizo Suzuki, Kodaira (JP); Hiroshi Kajiyama, Hitachi (JP); Shirun Ho, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 211 days.

(21) Appl. No.: 10/077,747

(22) Filed: Feb. 20, 2002

(65) Prior Publication Data

US 2003/0117345 A1 Jun. 26, 2003

(30) Foreign Application Priority Data

Dec. 21, 2001 (JP) ..... 2001-389804

(51) Int. Cl.[7] ..... G09G 3/28

(52) U.S. Cl. ..... 345/67; 345/63; 345/68; 315/169.4

(58) Field of Search ..... 345/60–72, 211, 345/212; 315/169.1, 169.4

(56) References Cited

U.S. PATENT DOCUMENTS 6,023,258 A * 2/2000 Kuriyama et al. ..... 345/60
6,256,002 B1 * 7/2001 Shinoda ..... 345/60
6,483,487 B2 * 11/2002 Iseki ..... 345/60
6,528,952 B2 * 3/2003 Kato et al. ..... 315/169.4

FOREIGN PATENT DOCUMENTS

| | | |
|---|---|---|
| JP | 11-143425 | 11/1997 |
| JP | 11-149274 | 11/1997 |
| JP | 2001-5424 | 6/1999 |
| WO | WO 98/21706 | 6/1997 |

* cited by examiner

*Primary Examiner*—Amr Awad
(74) *Attorney, Agent, or Firm*—Reed Smith LLP; Stanley P. Fisher, Esq.; Juan Carlos A. Marquez, Esq.

(57) ABSTRACT

A plasma display device includes plural discharge cells each defined by a pair of first and second discharge-sustaining electrodes and an address electrode intersecting therewith. A driving method thereof includes period for addressing the discharge cells and thereby inducing address-discharge therein, and light-emission period for applying repetitive pulse voltages to at least one of the first and second discharge-sustaining electrodes such that the addressed ones of the discharge cells start and sustain main discharge depending upon the presence of the address-discharge to generate light. Second repetitive pulse voltages are applied to the address electrodes to generate pre-discharge, and rise in portions of the light-emission period during which an absolute value of a voltage difference between the first and second discharge-sustaining electrodes does not exceed 0.9×a maximum of an absolute value of a voltage difference between the first and second discharge-sustaining electrodes during the light-emission period.

21 Claims, 17 Drawing Sheets

AT TIME a

AT TIME b1

AT TIME b2

AT TIME c $$W=\int (js1W(t)\cdot Vs1W(t)+js2W(t)\cdot Vs2W(t)+jsaW(t)\cdot VsaW(t))dt$$

$$\int_{ts1s}^{ts1p}\delta\, js1(t)dt \Big/ \int_{ts1p}^{ts1e}\delta\, js1(t)dt$$

$$\int_{ts1s}^{ts1p}\delta\, js1(t)dt>1.5\times \int_{ts1p}^{ts1e}\delta\, js1(t)dt$$

PLASMA DISPLAY DEVICE AND A METHOD OF DRIVING THE SAME

BACKGROUND OF THE INVENTION

The present invention relates to a plasma display device employing a plasma display panel (hereinafter referred to as a PDP) and a method of driving the PDP, and in particular is effective for improving ultraviolet-light-producing efficiency and thereby improving luminous efficacy.

Recently, quantity production of plasma display devices employing the ac surface-discharge type PDP has been started for use as large-area, thin-profile, color display devices. The ac surface-discharge type PDP is driven by ac voltages for generating surface-discharge.

FIG. 7 is an exploded perspective view of an example of a conventional ac surface-discharge type PDP employing a three-electrode structure.

In the ac surface-discharge type PDP shown FIG. 7, a discharge space 33 is formed between a pair of opposing glass substrates, a front substrate 21 and a rear substrate 28. The discharge space 33 is filled with a discharge gas at several hundreds or more of Torrs. As the discharge gas, usually He, Ne, Xe, and Ar are used either alone or in combination with one or more of the others.

A plurality of pairs of X and Y electrodes for sustaining discharge (hereinafter called discharge-sustaining electrodes or sustain-discharge electrodes) are disposed on the underside of the front substrate 21 serving as a display screen, for discharge-sustaining mainly for light emission for forming a display.

In this specification, "discharge-sustaining" and "sustain-discharge" are used interchangeably.

Usually, each of the X and Y electrodes is made of a combination of a transparent electrode and an opaque electrode for supplementing conductivity of the transparent electrode.

The X electrodes are comprised of transparent X electrodes 22-1, 22-2, . . . and corresponding opaque X bus electrodes 24-1, 24-2, . . . , respectively, and the Y electrodes are comprised of transparent Y electrodes 23-1, 23-2, . . . and corresponding opaque Y bus electrodes 25-1, 25-2, . . . , respectively. It is often that the X electrodes are used as a common electrode and the Y electrodes are used as independent electrodes.

A discharge gap Ldg between the X and Y electrodes in one discharge cell are designed to be small such that a discharge start voltage is not excessively high, and a spacing Lng between two adjacent cells is designed to be large such that unwanted discharge is prevented from occurring between two adjacent cells.

The X and Y sustain-discharge electrodes are covered with a front dielectric substance 26 which, in turn, is covered with a protective film 27 made of material such as magnesium oxide (MgO).

The MgO protects the front dielectric substance 26 and lowers a discharge start voltage because of its high sputtering resistance and high secondary electron emission yield.

Address electrodes 29 for addressing cells and thereby generating address-discharge are arranged on the upper surface of the rear substrate 28 in a direction perpendicular to the X and Y sustain-discharge electrodes.

The address electrodes 29 are covered with a rear dielectric substance 30, separation walls 31 are disposed between the address electrodes 29 on the rear dielectric substance 30.

A phosphor 32 is coated in a cavity formed by the surfaces of the separation walls 31 and the upper surface of the rear dielectric substance 30.

In this configuration, an intersection of a pair of sustain-discharge X, Y electrodes with an address electrode 29 corresponds to one discharge cell, and the discharge cells are arranged in a two-dimensional fashion. In a color PDP, a trio of three discharge cells coated with red, green and blue phosphors, respectively, forms one pixel.

FIG. 8 and FIG. 9 are cross-sectional views of one discharge cell shown in FIG. 7 viewed in the directions of the arrows D1 and D2, respectively. In FIG. 9, the boundary of the cell is approximately represented by broken lines. In FIG. 9, reference numeral denote electrons, 4 is a positive ion, 5 is a positive wall charge, and 6 are negative wall discharges.

Next operation of the PDP of this example will be explained.

The principle of generation of light by the PDP is such that discharge is started by a voltage pulse applied between the X and Y electrodes, and then ultraviolet rays generated by excited discharge gases are converted into visible light by the phosphor.

FIG. 10 is a block diagram illustrating a basic configuration of a plasma display device. The PDP 100 is incorporated into the plasma display device 102. A driving circuit 101 receives signals for a display image from a video signal source 103, converts the signals into driving voltages, and then supplies them to respective electrodes of the PDP 100. Concrete examples of the driving voltages are illustrated in FIGS. 11A–11C.

FIG. 11A is a time chart illustrating a driving voltage during one TV field required for displaying one picture on the PDP shown in FIG. 7. FIG. 11B illustrates waveforms of voltages applied to the address electrode 29, the X electrode and the Y electrode during the address-discharge period 50 shown in FIG. 11A. FIG. 11C illustrates pulse driving voltages (or voltage pulses) applied to the X and Y electrodes serving to sustain discharge and a driving voltage applied to the address electrode, all at the same time during the light-emission period 51 shown in FIG. 11A.

Portion I of FIG. 11A illustrates that one TV field 40 is divided into sub-fields 41 to 48 having different numbers of light emission more than one from one another. Gray scales are generated by a combination of one or more selected from among the sub-fields.

Suppose the eight sub-fields are provided which have gray scale brightness steps in binary number step increments, then each discharge cell of a three-primary color display device provides $2^8$(=256) gray scales, and as a result the three-primary color display device is capable of displaying about 16.78 millions of different colors.

Portion II of FIG. 11A illustrates that each sub-field comprises a reset-discharge period 49 for resetting the discharge cells to an initial state, an address period 50 for addressing discharge cells to be selected and made luminescent, and a light-emission period (also called a sustain-discharge period) 51.

FIG. 11B illustrates waveforms of voltages applied to the address electrode 29, the X electrode and the Y electrode during the address-discharge period 50 shown in FIG. 11A. A waveform 52 represents a voltage V0(V) applied to one of the address electrodes 29 during the address-discharge period 50, a waveform 53 represents a voltage V1(V) applied to the X electrode, and waveforms 54 and 55 represent voltages V21(V) and V22(V) applied to ith and (i+1)st Y electrodes.

As shown in FIG. 11B, when a scan pulse 56 is applied to the ith Y electrode, in a cell located at an intersection of the ith Y electrode with the address electrode 29 supplied with the voltage V0, first an address-discharge occurs between the Y electrode and the address electrode, and then between the Y electrode and the X electrode. No address-discharges occur at cells located at intersections of the X and Y electrodes with the address electrode 29 at ground potential.

The above applies to a case where a scan pulse 57 is applied to the (i+1)st Y electrode.

As shown in FIG. 9, in the cell where the address-discharge has occurred, charges (wall discharges) are generated by the discharges on the surface of the dielectric substance 26 and the protective film 27 covering the X and Y electrodes, and consequently, a wall voltage Vw(V) occurs between the X and Y electrodes. In FIG. 9, reference numeral 3 denote electrons, 4 is a positive ion, 5 is a positive wall charge, and 6 are negative wall charges. Occurrence of sustaining discharge during the succeeding light-emission period 51 depends upon the presence of this wall charge.

FIG. 11C illustrates pulse driving voltages (or voltage pulses) applied to the X and Y sustain-discharge electrodes serving to sustain the discharge and a driving voltage applied to the address electrode, all at the same time during the light-emission period 51 shown in FIG. 11A.

The Y electrode is supplied with a pulse driving voltage of a voltage waveform 58, the X electrode is supplied with a pulse driving voltage of a voltage waveform 59, the magnitude of the voltages of the waveforms 58 and 59 being V3(V).

The address electrode 29 is supplied with a driving voltage of a voltage waveform 60 which is kept at a fixed voltage V4 during the light-emission period 51. The voltage V4 may be selected to be ground potential.

The pulse driving voltage of the magnitude V3 is applied alternately to the X electrode and the Y electrode, and as a result reversal of the polarity of the voltage between the X and Y electrodes is repeated.

The magnitude V3 is selected such that the presence and absence of the wall voltage generated by the address-discharge correspond to the presence and absence of the sustaining discharge, respectively.

In the discharge cell where the address-discharge has occurred, discharge is started by the first voltage pulse applied to one of the X and Y electrodes (the pulse 58A applied to the Y electrode in FIG. 11C), and the discharge continues until wall charges of the opposite polarity accumulate to some extent. The wall voltage accumulated due to this discharge serves to reinforce the second voltage pulse applied to the other of the X and Y electrodes (the pulse 59A applied to the X electrode in FIG. 11C), and then discharge is started again.

The above is repeated by the third, fourth and succeeding pulses (in FIG. 11C, a pulse 58B applied to the Y electrode, a pulse 59B applied to the X electrode, and so on).

In this way, in the discharge cell where the address-discharge has occurred, sustain-discharges occur between the X and Y electrodes the number of times equal to the number of the applied voltage pulses and thereby emit light. On the other hand, the discharge cells do not emit light where the address-discharge has not occurred.

The above are the basic configuration of the usual plasma display device and a usual driving method thereof.

The following are some of principal conventional techniques for driving the plasma display panel.

(1) Japanese Patent Application Laid-Open No. P2001-504243A (laid open on Mar. 27, 2001, and corresponding to International publication number WO98/21706) aims at improving deterioration in operating margin as in a case where the width of discharge-sustaining pulses is narrow in the range of 1 $\mu$s or less, by applying space-charge-controlling, non-discharge-generating pulses to at least one of a pair of electrodes and an address electrode during a discharge-sustaining period so as to produce a space charge before main discharge. However, the peak value of the space-charge-controlling, non-discharge-generating pulses is limited such that no self-sustaining discharge is generated.

(2) Japanese Patent Application Laid-Open No. Hei 11-143425 (laid open on May 28, 1999) generates short-period discharges between facing electrodes by applying positive narrow-width pulses to address electrodes simultaneously with application of ac voltage pulses on the sustain-discharge electrodes, and then produces main discharge by using the short-period discharges as their triggers. This configuration aims at the advantage that the driving voltage can be kept to a low voltage as in a usual discharge gap even when the discharge gap is increased. However, the positive narrow-width pulses are applied to the address electrodes simultaneously with application of ac voltage pulses on the sustain-discharge electrodes, and therefore this is not intended to generate pre-discharge prior to main discharge.

(3) Japanese Patent Application Laid-Open No. Hei 11-149274 (laid open on Jun. 2, 1999) discloses a configuration in which two or more third electrodes are provided to oppose a pair of first and second sustain-discharge electrodes in each of discharge cells, and during the sustain-discharge period, pulses are applied to the third electrodes which rise (voltages change in the positive direction) prior to sustain-discharge pulses applied to the first and second electrodes, and then fall rapidly (voltages change in the negative direction) after cessation of main discharge, so as to limit the peak value of discharge currents. This configuration aims at the advantage of reducing the cost of the driving circuit and reducing defective image displays. The object of this patent application is to quicken the main discharge and thereby reduce the peak value of the discharge currents.

(4) Japanese Patent Application Laid-Open No. 2001-5424 (laid open on Jan. 12, 2001) aims at improving efficiency by applying a pre-discharge voltage to a data electrode (an address electrode) prior to sustain-discharge between the sustain-discharge electrodes, and thereby generating pre-discharge (only between the facing electrodes) during the sustain-discharge period. However, this patent application does not intend to increase efficiency by utilizing the highly efficient discharge between the sustain-discharge electrodes as the predischarge.

SUMMARY OF THE INVENTION

At present, efficiency of the PDP is inferior to that of a cathode ray tube, and therefore improvement of the efficiency of the PDP is necessary for wide spread of the PDPs as TV receivers.

There is also a problem in that, in realization of a large-screen PDP, a current to be supplied to its electrodes increases excessively and the power consumption increases.

In order to increase the number of pixels and thereby increase the degree of definition of a display image, it is necessary to reduce the size of the discharge cells. In this case also, there is also a problem in that the luminous efficacy is reduced because of the reduction in ultraviolet-light-producing efficiency caused by the decrease of the discharge space.

Basically, the improvement of luminous efficacy of the PDP is essential for solving the above problems. The present invention provides a technique for improving luminous efficacy in the sustaining discharge by improvement in a driving method for the plasma display device employing the PDP.

The following explains briefly the summary of the representative ones of the present inventions disclosed in this specification.

In accordance with an embodiment of the present invention there is provided a method of driving a plasma display device having a plasma display panel including a plurality of pairs of first and second discharge-sustaining electrodes, a plurality of address electrodes arranged to intersect the plurality of pairs of first and second discharge-sustaining electrodes, a dielectric substance covering the plurality of pairs of first and second discharge-sustaining electrodes, and a plurality of discharge cells defined by the plurality of pairs of first and second discharge-sustaining electrodes and the plurality of address electrodes; the method including at least address-discharge period for addressing the plurality of discharge cells and thereby inducing address-discharge therein; and light-emission period for applying repetitive discharge-sustaining pulse voltages to at least one of the first and second discharge-sustaining electrodes such that the addressed ones of the plurality of discharge cells start and sustain main discharge depending upon the presence of the address-discharge to generate light for formation of a display wherein second repetitive pulse voltages are applied to the plurality of address electrodes to generate pre-discharge, the pre-discharge initially occurring between the address electrodes of the addressed ones of the plurality of discharge cells and one of the first and second discharge-sustaining electrodes of the addressed ones, and thereafter occurring between the first and second discharge-sustaining electrodes of the addressed ones, and the second repetitive pulse voltages rise in portions of the light-emission period during which an absolute value of a voltage difference between the pair of first and second discharge-sustaining electrodes does not exceed 0.9×a maximum of an absolute value of a voltage difference between the pair of first and second discharge-sustaining electrodes during the light-emission period.

In accordance with another embodiment of the present invention there is provided a method of driving a plasma display device including a plasma display panel having a plurality of discharge cells, each of the plurality of discharge cells being provided with a pair of discharge-sustaining electrodes, an address electrode disposed to intersect the pair of discharge-sustaining electrodes, and a dielectric substance covering the pair of discharge-sustaining electrodes; the method including at least address-discharge period for addressing the plurality of discharge cells and thereby inducing address-discharge therein; and light-emission period for applying repetitive discharge-sustaining pulse voltages to at least one of the first and second discharge-sustaining electrodes such that the addressed ones of the plurality of discharge cells start and sustain main discharge depending upon the presence of the address-discharge to generate light for formation of a display, wherein second repetitive pulse voltages are applied to the plurality of address electrodes to generate pre-discharge, the pre-discharge occurs at least during a portion of at least one of intervals of time, the pre-discharge initially occurring between the address electrodes of the addressed ones of the plurality of discharge cells and one of the first and second discharge-sustaining electrodes of the addressed ones, and thereafter occurring between the first and second discharge-sustaining electrodes of the addressed ones, where t1≦the interval of time≦t2, V3 is a maximum of an absolute value of a voltage difference between the first and second discharge-sustaining electrodes during the light-emission period, S1 periods are each defined as periods which straddle respective valleys of a waveform of the absolute value of the voltage difference, and during which the absolute value of the voltage difference is less than or equal to 0.9×V3, t1 is a time at which each of the S1 periods starts, S2 periods are each defined as periods during which the absolute value of the voltage difference is less than or equal to 0.5×V3 within a respective one of the S1 periods, and t2 is a time at which each of the S2 periods ends.

In accordance with another embodiment of the present invention there is provided method of driving a plasma display device including a plasma display panel having a plurality of discharge cells, each of the plurality of discharge cells being provided with a pair of discharge-sustaining electrodes, an address electrode disposed to intersect the pair of discharge-sustaining electrodes, and a dielectric substance covering the pair of discharge-sustaining electrodes; the method including at least address-discharge period for addressing the plurality of discharge cells and thereby inducing address-discharge therein; and light-emission period for applying repetitive discharge-sustaining pulse voltages to at least one of the first and second discharge-sustaining electrodes such that the addressed ones of the plurality of discharge cells start and sustain main discharge depending upon the presence of the address-discharge to generate light for formation of a display, wherein second repetitive pulse voltages are applied to the plurality of address electrodes to generate pre-discharge, the pre-discharge occurs during intervals of time, the pre-discharge initially occurring between the address electrodes of the addressed ones of the plurality of discharge cells and one of the first and second discharge-sustaining electrodes of the addressed ones, and thereafter occurring between the first and second discharge-sustaining electrodes of the addressed ones, where t1≦the interval of time≦t2, V3 is a maximum of an absolute value of a voltage difference between the first and second discharge-sustaining electrodes during the light-emission period, S1 periods are each defined as periods which straddle respective valleys of a waveform of the absolute value of the voltage difference, and during which the absolute value of the voltage difference is less than or equal to 0.9×V3, t1 is a time at which each of the S1 periods starts, S2 periods are each defined as periods during which the absolute value of the voltage difference is less than or equal to 0.5×V3 within a respective one of the S1 periods, and t2 is a time at which each of the S2 periods ends.

In accordance with another embodiment of the present invention there is provided a method of driving a plasma display device including a plasma display panel having a plurality of discharge cells, each of the plurality of discharge cells being provided with a pair of first and second discharge-sustaining electrodes, an address electrode disposed to intersect the pair of first and second discharge-sustaining electrodes, and a dielectric substance covering the pair of first and second discharge-sustaining electrodes; the method including at least address-discharge period for addressing the plurality of discharge cells and thereby inducing address-discharge therein; and light-emission period for applying repetitive discharge-sustaining pulse voltages to at least one of the pair of first and second discharge-sustaining electrodes such that the addressed ones of the plurality of discharge cells start and sustain main discharge depending upon the presence of the address-discharge to generate light for formation of a display, wherein an address voltage comprised of second repetitive pulse voltages is applied to the plurality of address electrodes to generate pre-discharge, the second repetitive pulse voltages changing in a positive direction during at least a portion of an interval of time, the pre-discharge initially occurring between the address electrodes of the addressed ones of the plurality of discharge cells and one of first and second the discharge-sustaining electrodes of the addressed ones, and thereafter occurring between the pair of first and second discharge-sustaining electrodes of the addressed ones, where t1≦the interval of time≦t2, V3 is a maximum of an absolute value of a voltage difference between the first and second discharge-sustaining electrodes during the light-emission period, S1 periods are each defined as periods which straddle respective valleys of a waveform of the absolute value of the voltage difference, and during which the absolute value of the voltage difference is less than or equal to 0.9×V3, t1 is a time at which each of the S1 periods starts, S2 periods are each defined as periods during which the absolute value of the voltage difference is less than or equal to 0.5×V3 within a respective one of the S1 periods, and t2 is a time at which each of the S2 periods ends.

In accordance with another embodiment of the present invention there is provided a plasma display device comprising: a plasma display panel including a plurality of pairs of first and second discharge-sustaining electrodes, a plurality of address electrodes arranged to intersect the plurality of pairs of first and second discharge-sustaining electrodes, a dielectric substance covering the plurality of pairs of first and second discharge-sustaining electrodes, a plurality of discharge cells defined by the plurality of pairs of first and second discharge-sustaining electrodes and the plurality of address electrodes; a pulse generating circuit having a voltage input terminal and a plurality of output terminals corresponding to the plurality of pairs of first and second discharge-sustaining electrodes and supplying pulses to the plurality of pairs of first and second discharge-sustaining electrodes for generating sustaining-discharge between the first and second discharge-sustaining electrodes, a driving circuit for selectively applying address-pulse voltages to the plurality of address electrodes of the plurality of discharge cells intended for formation of a display, and a control circuit for controlling pre-discharge pulse voltages such that the pre-discharge pulse voltages are applied to the plurality of address electrodes to generate pre-discharge for triggering the sustaining-discharge, the pre-discharge initially occurring between the address electrodes of the addressed ones of the plurality of discharge cells and one of the first and second discharge-sustaining electrodes of the addressed ones, and thereafter occurring between the first and second discharge-sustaining electrodes of the addressed ones, and the pre-discharge pulse voltages rise in portions of the light-emission period during which an absolute value of a voltage difference between the pair of first and second discharge-sustaining electrodes does not exceed 0.9×a maximum of an absolute value of a voltage difference between the pair of first and second discharge-sustaining electrodes during the light-emission period.

The configuration of the PDP itself used in the present invention is not limited to those illustrated below concretely, but other configurations of the PDP can be used. Plasma display panels are sufficient which are provided at least with a plurality of pairs of first and second sustain-discharge electrodes, a plurality of address electrodes arranged to intersect the pairs of first and second sustain-discharge electrodes, and a plurality of discharge cells formed at intersections of the pairs of first and second sustain-discharge electrodes and the address electrodes.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

Figure 1A:
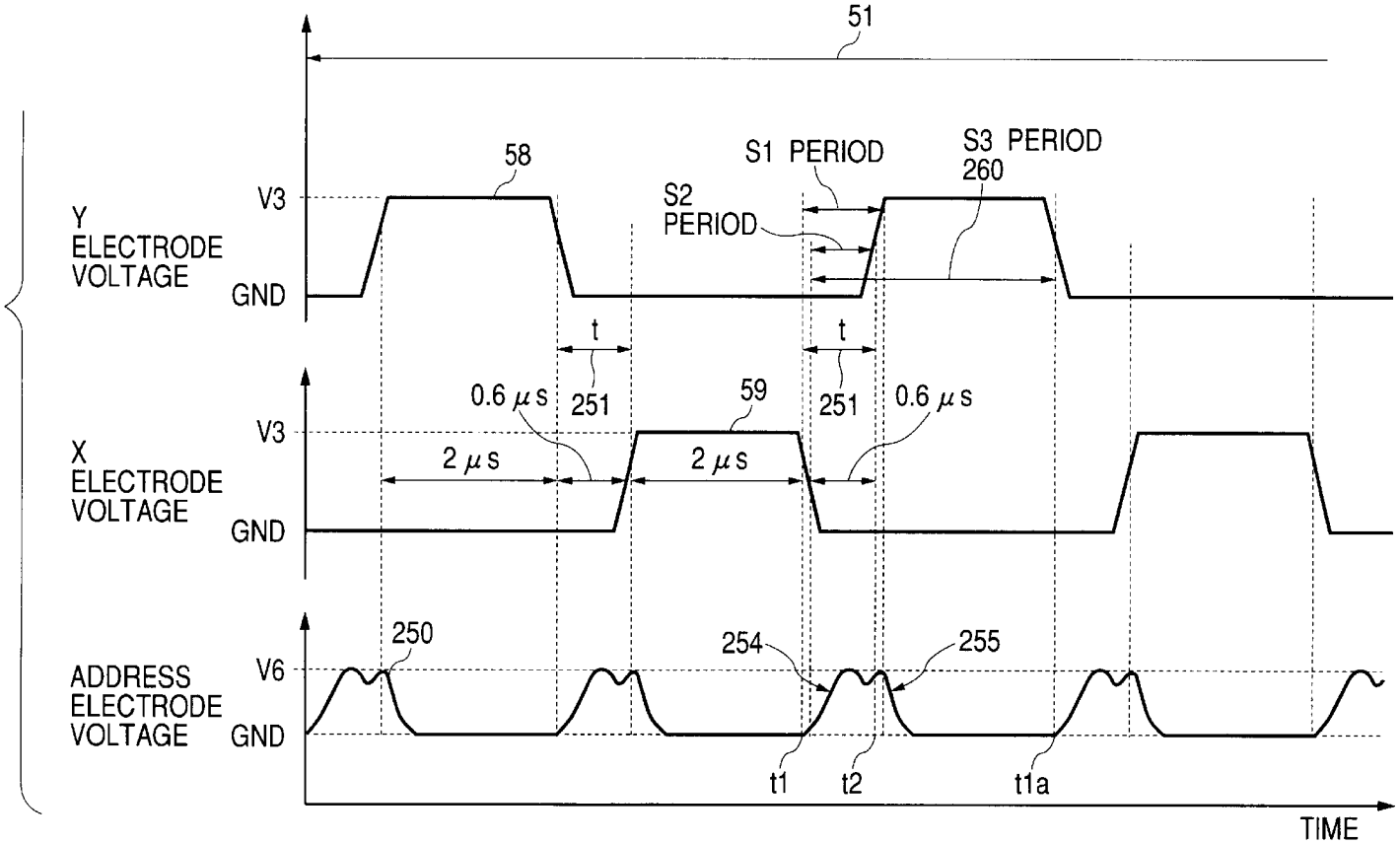
FIG. 1A illustrates a voltage sequence for a PDP of a plasma display device in accordance with the present invention.

Now the embodiments of the present invention will be explained in detail by reference to the drawings. All the drawings for the embodiments use the same reference numerals to identify parts performing the same functions, which are not repeatedly explained in the specification.

Embodiment 1

Figures 1B, 1C:
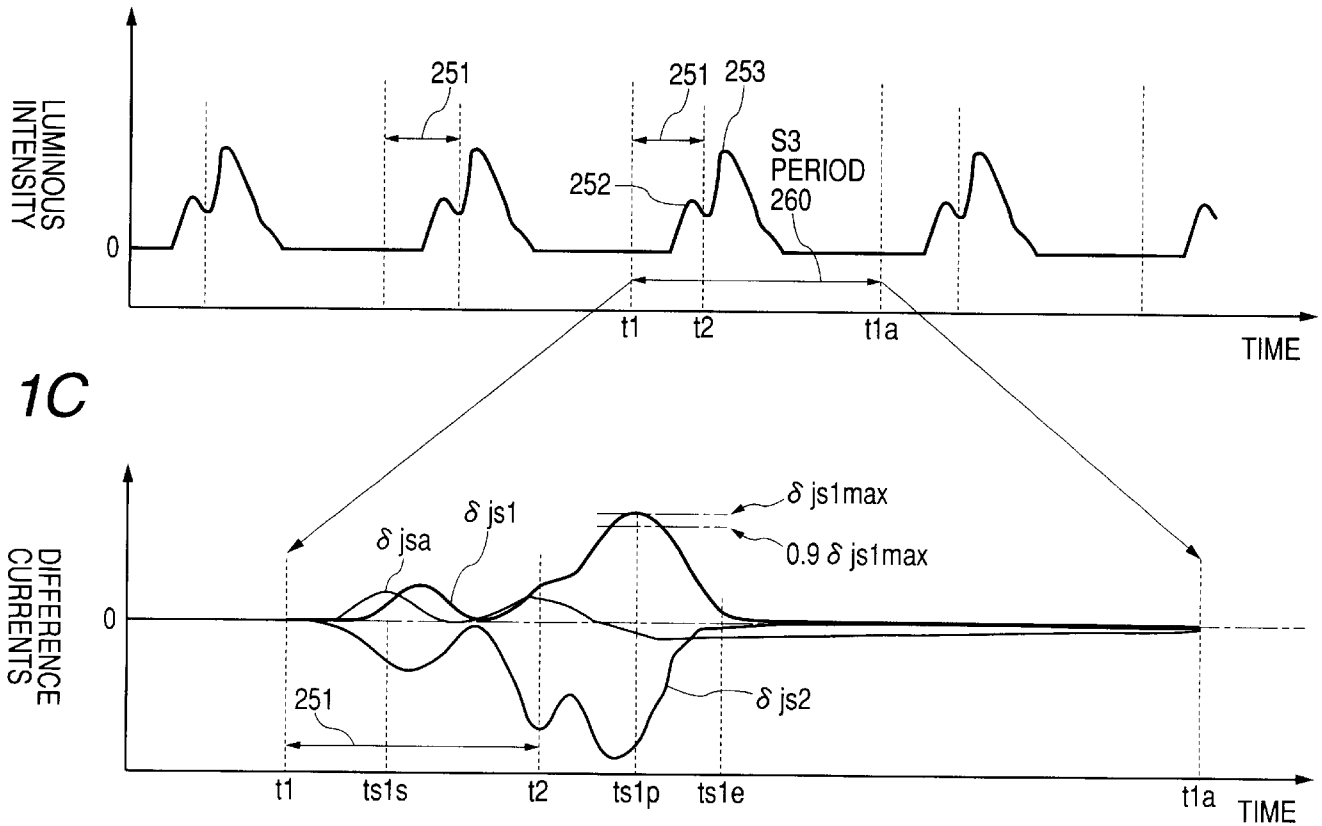
FIG. 1B illustrates a waveform of Xe 823 nm light emission (light emission of 823 nm in wavelength from excited Xe elements)
FIG. 1C illustrates waveforms of difference currents in the PDP.

FIG. 1A illustrates a voltage sequence for a PDP of a plasma display device in accordance with Embodiment 1 of the present invention, FIG. 1B illustrates a waveform of Xe 823 nm light emission (light emission of 823 nm in wavelength from excited Xe elements), and FIG. 1C illustrates waveforms of difference currents. The time axes represented on the abscissas are aligned with each other in FIGS. 1A–1C.

Figure 2:
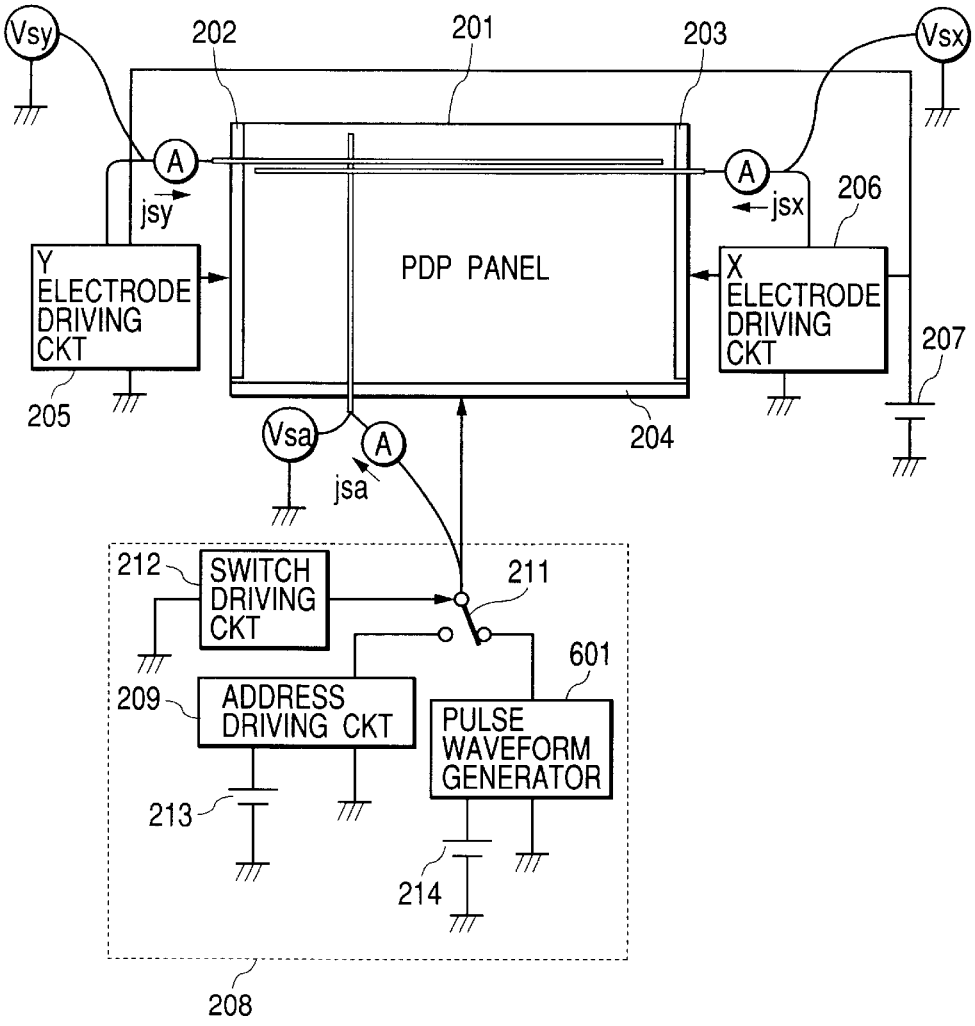
FIG. 2 is a block diagram illustrating a rough configuration of a plasma display device in accordance with the present invention and a measurement system therefor.

FIG. 2 is a block diagram illustrating a rough configuration of the plasma display device in accordance with Embodiment 1 of the present invention, and a measurement system therefor. In FIG. 2 and succeeding figures, lines for supply voltages for driving circuits are omitted.

The basic configuration of the plasma display device of this embodiment is as follows.

As shown in FIG. 2, the plasma display device of Embodiment 1 comprises a PDP 201, a Y-electrode terminal portion 202, an X-electrode terminal portion 203, an address electrode terminal portion 204, a Y-electrode driving circuit 205, an X-electrode driving circuit 206, a power supply 207 for supplying voltages and powers to the Y-electrode and X-electrode driving circuits 205, 206, and an address power-source driving section 208.

The address power-source driving section 208 comprises an address-driving circuit 209, a pulse waveform generator 601, a switch 211 for switching between the address-driving circuit 209 and the pulse waveform generator 601 in specified timing, a switch driving circuit 212 for controlling the switch 211, and power sources 213, 214 for supplying voltages and electric powers to the address-driving circuit 209 and the pulse waveform generator 601, respectively.

The main differences between the PDP of this embodiment and the conventional PDP are as follows.

Figure 11A:
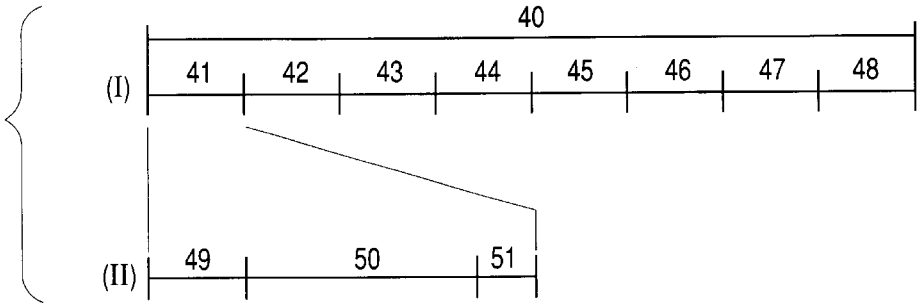
FIG. 11A is a time chart illustrating a driving voltage during one TV field required for displaying one picture on the PDP shown in FIG. 7.
Figure 11B:
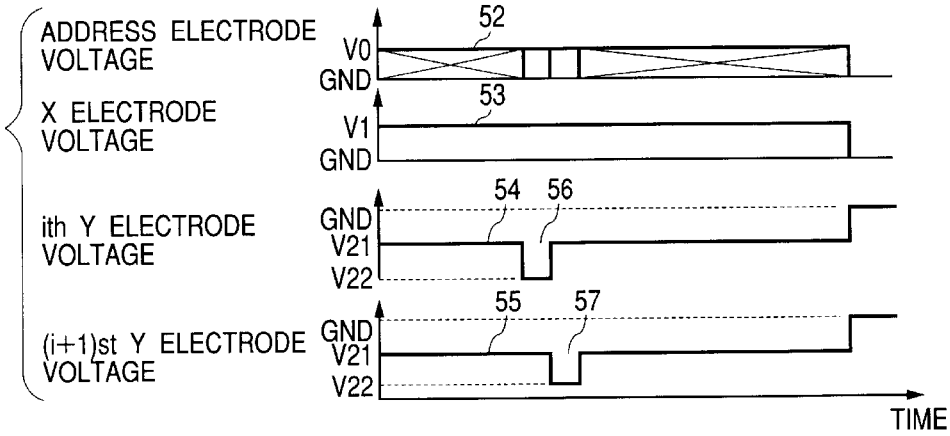
FIG. 11B illustrates waveforms of voltages applied to the address electrode, the X electrode and the Y electrode during the address-discharge period shown in FIG. 11A.
Figure 11C:
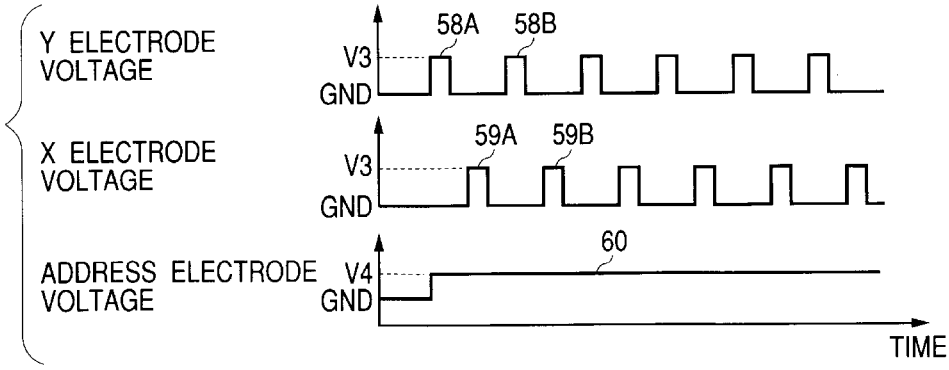
FIG. 11C illustrates pulse driving voltages (or voltage pulses) applied to the X and Y electrodes serving to sustain discharge and a driving voltage applied to the address electrode, all at the same time during the light-emission period 51 shown in FIG. 11A.

In the conventional technique, as shown in FIG. 11C, the address electrode 29 has applied thereon a fixed voltage V4 represented by a waveform 60 during the light-emission period 51. On the other hand, Embodiment 1 of the present invention is different from the conventional technique in that, as shown in FIG. 1A, the address electrode 29 has applied thereon address pulse voltages having a peak value V6, and in the circuit configuration, as shown in FIG. 2, the switch 211 is connected to the pulse waveform generator 601 during the light-emission period 51, and thereby the address pulse voltages are supplied to the address electrode 29.

Next, a driving method of the plasma display device of Embodiment 1 will be explained by referring to FIGS. 1A–1C. FIG. 1A illustrates voltage sequence of the Y electrode, the X electrode, and the address electrode of the PDP. The basics of the driving method during one TV field period for the PDP is the same as that shown in FIG. 11A. That is to say, each of the sub-fields comprises the reset-discharge period 49 for resetting the discharge cells to the initial state, the address-discharge period 50 for selecting (addressing) the discharge cells intended for light emission, and the light emission period 51 (also called the sustain-discharge period) for formation of an image display.

The discharge period includes at least the address-discharge period 50 for selecting discharge cells intended for light emission, and the light-emission period 51 for generating discharge-light-emission by applying pulse voltages repeatedly and alternately to the X electrodes and the Y electrodes as in the case of the conventional technology.

The switch 211 is connected to the address-driving circuit 209 during the address-discharge period 50, and then the resultant address-discharge generates the wall voltage Vw(V) between the X and Y electrodes of the discharge cells intended for light emission by discharge during the light-emission period 51 succeeding the address-discharge period 50. In this way, the discharge cells intended for light emission during the light-emission period 51 are selected.

Figure 7:
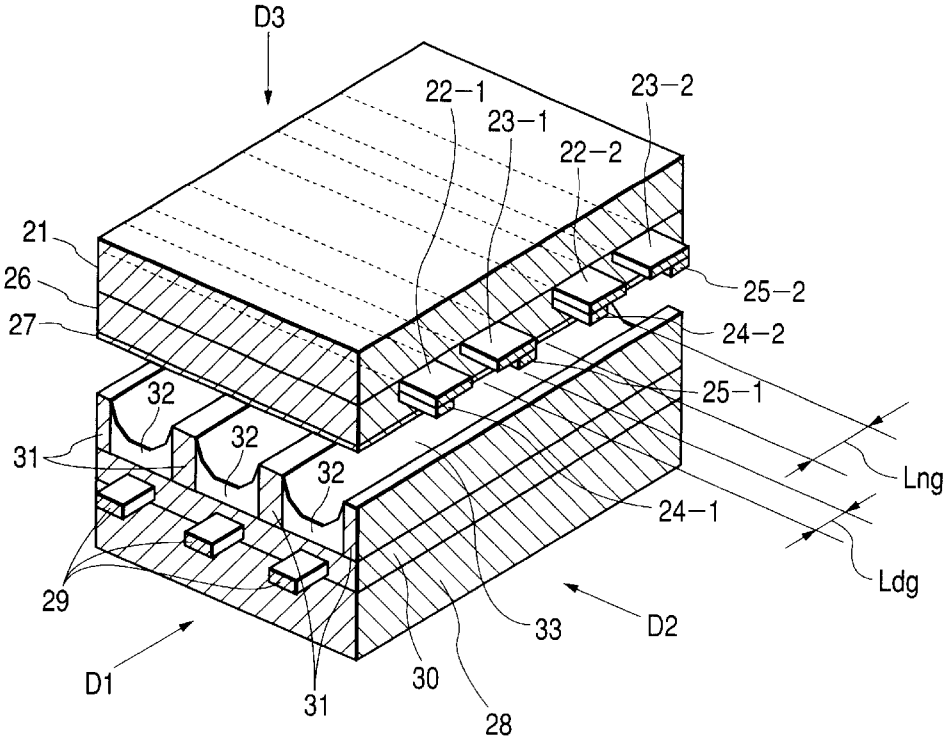
FIG. 7 is an exploded perspective view of an example of an ac surface-discharge type PDP employing a three-electrode structure.
Figure 8:
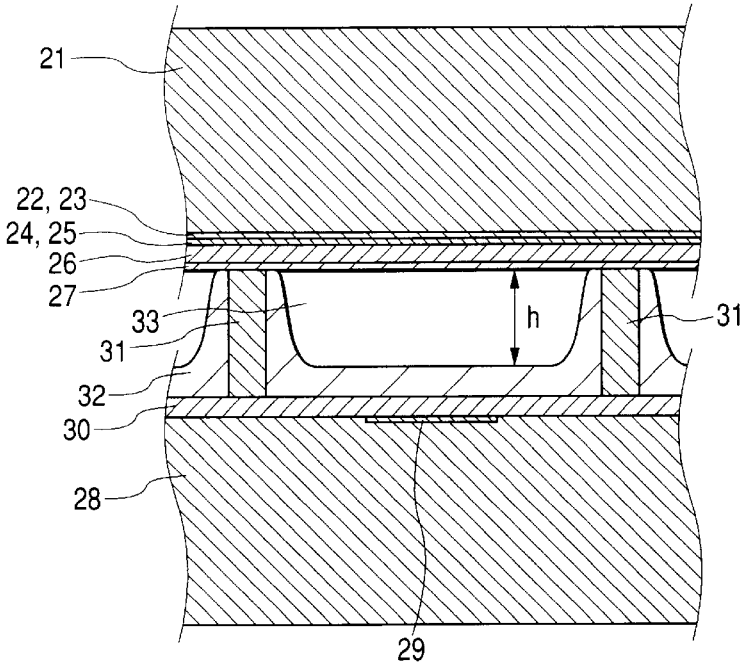
FIG. 8 is a cross-sectional view of one discharge cell shown in FIG. 7 viewed in the directions of the arrow D1.
Figure 9:
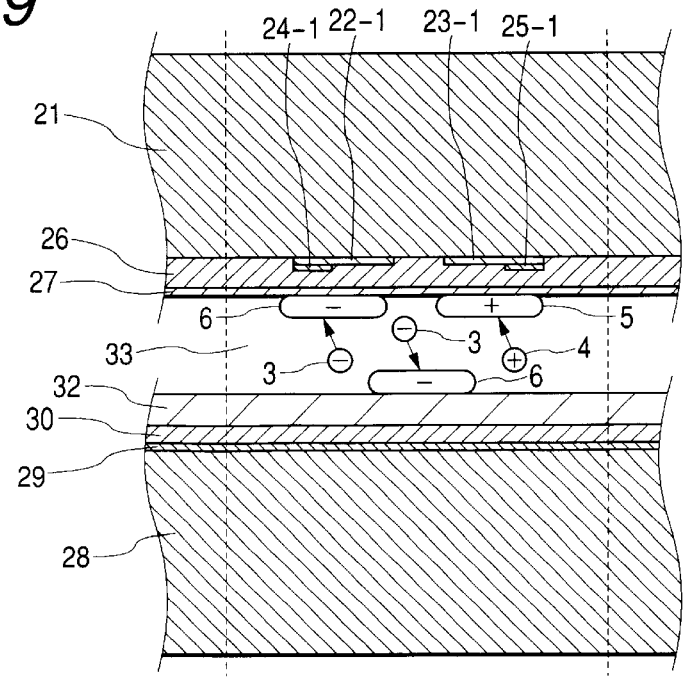
FIG. 9 is a cross-sectional view of the one discharge cell shown in FIG. 7 viewed in the directions of the arrow D2.
Figure 10:
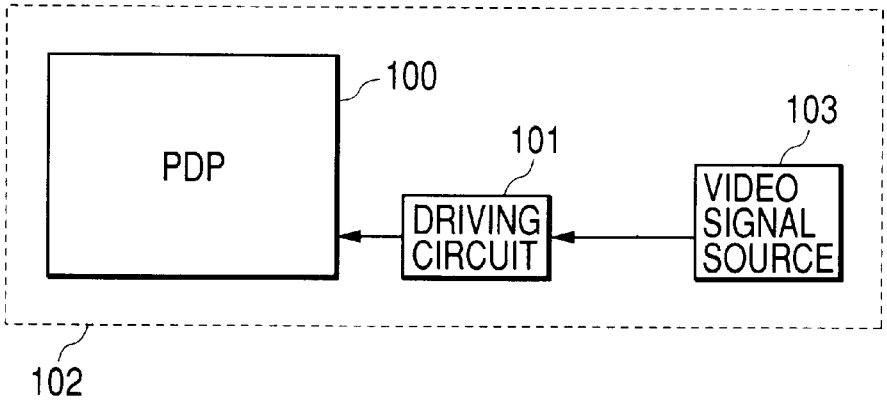
FIG. 10 is a block diagram illustrating a basic configuration of a plasma display device.

Next, appropriate voltages are applied between the X electrodes (composed of the electrodes 22 and 24 shown in FIG. 7) and the Y electrodes (composed of the electrodes 23 and 25 shown in FIG. 7) and between the address electrode 29 and the X and Y electrodes during the light-emission period 51 such that discharges occur between the X electrodes and the Y electrodes and between the address electrode 29 and the X, Y electrodes only when the above-explained wall voltages are present between the X and Y electrodes during the light-emission period 51, and consequently, only the intended cells are caused to discharge and emit light.

FIG. 1A illustrates waveforms of the discharge-sustain voltages applied to the X and Y electrodes, respectively, at the same time during the light-emission period 51.

The Y electrodes are supplied with a sustain-discharge pulse drive voltage of a waveform 58 having a peak value of V3(V), and the X electrodes are supplied with a sustain-discharge pulse drive voltage of a waveform 59 having a peak value of V3(V). Pulse voltage having the peak value of V3(V) are applied alternately to the X electrode and the Y electrode, and thereby reversal of the polarity of the voltage between the X and Y electrodes is repeated.

The magnitude V3 is selected such that the presence and absence of the wall voltage generated by the address-discharge correspond to the presence and absence of the sustain-discharge, and the voltage V3 is called the sustain-discharge voltage.

During the light-emission period 51, the switch 211 is connected to the pulse waveform generator 601 (see FIG. 2), and the address electrode 29 is supplied with a pulse voltage of a waveform 250 having a peak value of V6(V) shown in FIG. 1A. The pulse voltage 250 shown in FIG. 1A changes significantly in the positive direction (rising represented by reference numeral 254 in FIG. 1A) during an interval of time 251, and changes significantly in the negative direction (falling represented by reference numeral 255 in FIG. 1A)

immediately after the interval of time 251. In this specification, "significantly" or "significant" is used to mean "with noise components being ignored."

Consider a waveform of the absolute value of a voltage difference between the pair of sustain-discharge electrodes during the light-emission period. V3 is the maximum value of the absolute value of the voltage difference. Each of periods which straddle respective valleys of the waveform and during which the absolute value of the voltage difference is less than or equal to 0.9×V3 is referred to as an S1 period. A time at which the S1 period starts is referred to as t1. Each of periods during which the absolute value of the voltage difference is less than or equal to 0.5×V3 within a respective one of the S1 periods is referred to as an S2 period. A time at which the S2 period ends is referred to as t2. An interval of time t denoted by reference numeral 251 in FIG. 1A is defined as a period from the time t1 to the time t2.

FIG. 1B illustrates a waveform of Xe 823 nm light emission (light emission of 823 nm in wavelength from excited Xe elements) during the light-emission period 51.

FIG. 2 illustrates a measurement system for measuring waveforms of voltages on and currents through the X, Y and address electrodes. The voltage waveforms were measured at exposed wiring conductors between the Y-electrode terminal portion 202 and the driving circuit 205, between the X-electrode terminal portion 203 and the driving circuit 206, and between the address-electrode terminal portion 204 and the driving circuit 208, respectively, by using an oscilloscope. The current waveforms were measured by connecting current probes between the respective electrodes and their corresponding driving circuits and using the oscilloscope. The measured currents are taken as positive when flowing into the respective electrodes from a circuit external to the plasma display panel 201.

In the measurement, the following two states are selected:

a state W is a state where a group comprising a specified number of discharge cells are selected, i.e., addressed to display a white image;

a state B is a state where the group comprising the specified number of discharge cells are non-selected, i.e., are set to display a black image, leaving the remainder of the discharge cells unchanged from the state W.

The following notation is employed:

Vs1W(t)=a waveform of a voltage on a first one of the pair of sustain-discharge electrodes of the group in the state W, Vs2W(t)=a waveform of a voltage on a second one of the pair of sustain-discharge electrodes of the group in the state W, VsaW(t)=a waveform of a voltage on an address electrode of the group in the state W, Vs1B(t)=a waveform of a voltage on the first one of the pair of sustain-discharge electrodes of the group in the state B, Vs2B(t)=a waveform of a voltage on the second one of the pair of sustain-discharge electrodes of the group in the state B, VsaB(t)=a waveform of a voltage on the address electrode of the group in the state B, js1W(t)=a current flowing into the first one of the pair of sustain-discharge electrodes of the group in the state W, js2W(t)=a current flowing into the second one of the pair of sustain-discharge electrodes of the group in the state W, jsaw(t)=a current flowing into one of the address electrodes of the group in the state W, js1B(t)=a current flowing into the first one of the pair of sustain-discharge electrodes of the group in the state B, js2B(t)=a current flowing into the second one of the pair of sustain-discharge electrodes of the group in the state B, jsaB(t)=a current flowing into one of the address electrodes of the group in the state B, the currents are taken as positive when flowing into corresponding electrodes from a circuit external to the plasma display panel, where the first one of the pair of sustain-discharge electrodes is at a positive potential with respect to the second one of the pair of sustain-discharge electrodes immediately after the interval of time, and in this example, the first one of the pair of sustain-discharge electrodes is the Y sustain-discharge electrode, and the second one of the pair of sustain-discharge electrodes is the X sustain-discharge electrode.

First the discharge power, luminance and luminous efficacy were compared between the driving method of the present invention and the conventional driving method. The discharge power W were calculated by integration over one period as represented by Equation 1 in FIG. 19A. The luminance B was measured by using a brightness meter, and the luminous efficacy $\eta$ was calculated by using the relationship $\eta \propto B/W$.

In the conventional driving method, the sustain-discharge voltage V3 was selected to be 180 V, and the voltage V4 applied to the address electrode during the light-emission period was selected to be 85 V (see FIG. 11C).

On the other hand, in the driving method of the present invention, the sustain-discharge voltage V3 was selected to be the same as in the conventional driving method, but the address electrode was supplied with a voltage pulse having a peak value V6 of 60 V during the light-emission period.

The ratios between the light-emissive discharge characteristic values of the present invention and the conventional driving method are as follows.

The discharge electric power ratio is 0.86, the luminance ratio is 1.12, and the luminous-efficacy ratio is 1.30. Therefore it was verified that the present invention improves the luminous efficacy by about 30% compared with the conventional driving method.

The following studies the mechanism by which the discharge efficiency and the luminous efficacy are improved in the present invention.

In FIGS. 1A and 1B, t1a is defined as a time at which an absolute value of a voltage difference between the pair of sustain-discharge electrodes decreases to 0.9×V3 first after the above-defined time t2 during the light-emission period, S3 period denoted by reference numeral 260 is defined as a period from the time t1 to the time t1a, js1W(t)=a current flowing into the first one of the pair of sustain-discharge electrodes of the group in the state W during the S3 period 260, js2W(t)=a current flowing into the second one of the pair of sustain-discharge electrodes of the group in the state W during the S3 period 260, jsaW(t)=a current flowing into one of the address electrodes of the group in the state W during the S3 period 260, js1B(t)=a current flowing into the first one of the pair of sustain-discharge electrodes of the group in the state B during the S3 period 260, js2B(t)=a current flowing into the second one of the pair of sustain-discharge electrodes of the group in the state B during the S3 period 260, jsaB(t)=a current flowing into the one of the address electrodes of the group in the state B during the S3 period 260, $$\delta js1(t)=js1W(t)-js1B(t),$$

$$\delta js2(t)=js2W(t)-js2B(t), \text{ and}$$

$$\delta jsa(t)=jsaW(t)-jsaB(t).$$

FIG. 1C illustrates the waveforms of the difference currents δjs1(t), δjs2(t) and δjsa(t) between the states W and B during the S3 period 260, and these waveforms of the difference currents can be considered as approximately equal to the discharge currents.

As shown in FIG. 1B, the pre-discharge 252 occurs in the interval of time 251.

As is apparent from FIG. 1C, the significantly negative difference current δjs2(t) and the significantly positive δjsa (t) are flowing during the interval of time 251. The reason is that vertical discharge between the second one (the X electrode) of the sustain-discharge electrodes and the address electrode is generated by the voltage difference between the positive voltage 250 on the address electrode 29 and the negative wall voltage over the second one (the X electrode) of the sustain-discharge electrodes which will serve as a cathode during the succeeding main discharge, with the aid of priming particles or the like. Immediately after this, the significantly positive δjs1(t) is flowing, delayed by a little time from δjsa(t). The reason may be that the surface-discharge has occurred between the second one (the X electrode) and the first one (the Y electrode) of the sustain-discharge electrodes due to the priming effect of the vertical discharge between the second one (the X electrode) and the address electrode. In this case, the discharge is generated by a weak electric field (a low discharge-space voltage) with the aid of the priming effect, and consequently, the ultraviolet-light-producing efficiency is increased. Further, it is thought that the surface-discharge (the main discharge) between the second one (the X electrode) and the first one (the Y electrode) of the sustain-discharge electrodes occurs simultaneously with rising of the voltage on the first one (the Y electrode) of the sustain-discharge electrodes. Both of the discharges are generated by the weak electric fields (the low discharge-space voltages) with the aid of the priming effect, and consequently, the ultraviolet-light-producing efficiency is increased remarkably. The fact that the ultraviolet-light-producing efficiency is increased by using the discharge under the weak electric field (the low discharge-space voltage) is disclosed in J. Appl. Phys. 88, p. 5605 (2000), for example.

The mechanism of the increase in the ultraviolet-light-producing efficiency will be explained by using surface potential models of the dielectric illustrated in FIGS. 12–15D.

Figure 12:
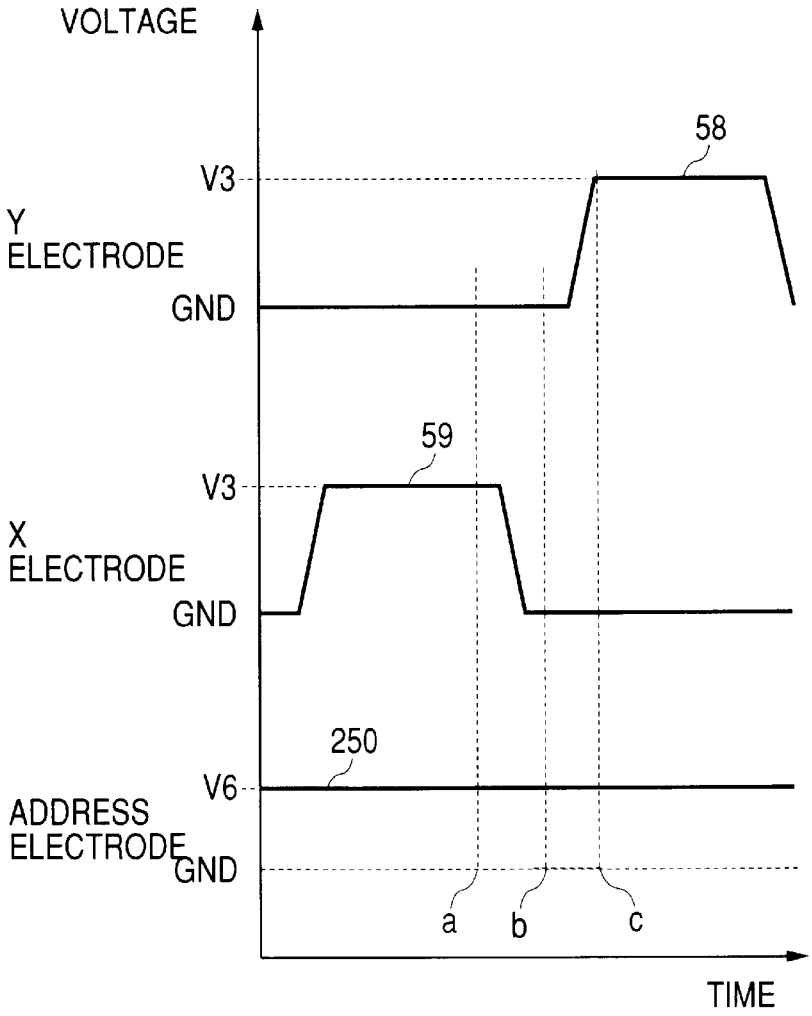
FIG. 12 PRIOR ART
FIG. 12 illustrates voltage waveforms in the conventional driving method.
Figure 13A:
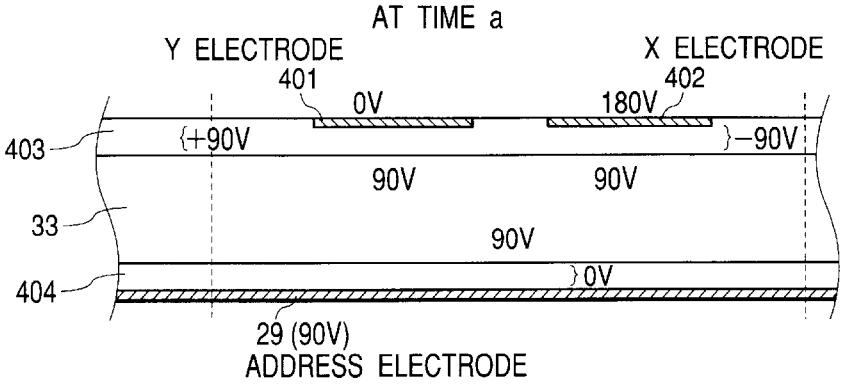
FIGS. 13A, 13B and 13C illustrate surface potential models of a dielectric at times a, b and c indicated in FIG. 12, respectively.
Figure 13B:
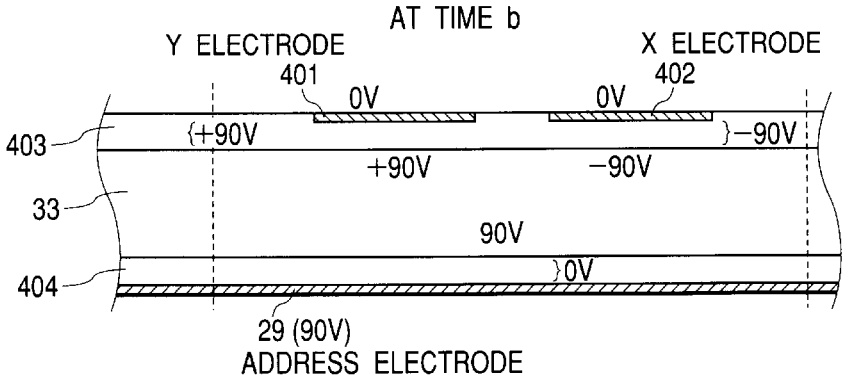
Figure 13C:
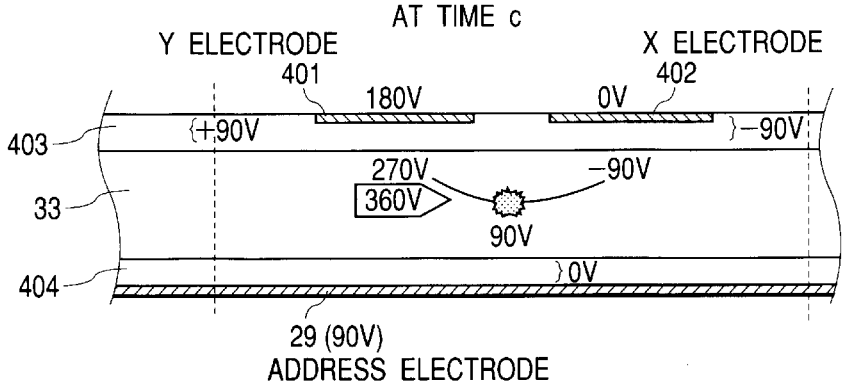

FIG. 12 illustrates voltage waveforms in the conventional driving method, and FIGS. 13A, 13B and 13C illustrate the surface potential models of the dielectric at times a, b and c in FIG. 12, respectively. In FIGS. 13A–13C, reference numerals 403 and 404 denote dielectric.

Suppose the voltage Vsy on the Y electrode is 180 V, the voltage Vsx on the X electrode is 180 V, and the voltage Vsa on the address electrode is 90 V. Suppose the discharge started by the voltage pulse on the X electrode has been completed by the time a to the extent that electric fields are absent in the discharge space. At this time a, all of the surface potentials on the dielectrics over the Y, X and address electrodes are 90 V, but there are produced wall voltages between the surface of the dielectrics and the Y, X and address electrodes, respectively, as indicated in FIG. 13A.

At time b during the interval of time, the voltage on the X electrode changes to 0 V, and as a result the surface potential of the dielectric over the X electrode changes to −90 V which is a wall voltage portion.

At time c, the voltage on the Y electrode changes to 180 V, and as a result a potential of 270 is generated on the surface of the dielectric over the Y electrode. At this time c, the potential difference between the two surfaces of the dielectrics over the X and Y electrodes changes to 360 V, which is over the discharge start voltage (about 230 V), and consequently, the surface-discharge is generated. On the other hand, the potential difference between the two surfaces of the dielectrics over the X and address electrodes is 180 V, which is below the discharge start voltage (about 210 V), and therefore no discharge occurs.

Figure 14:
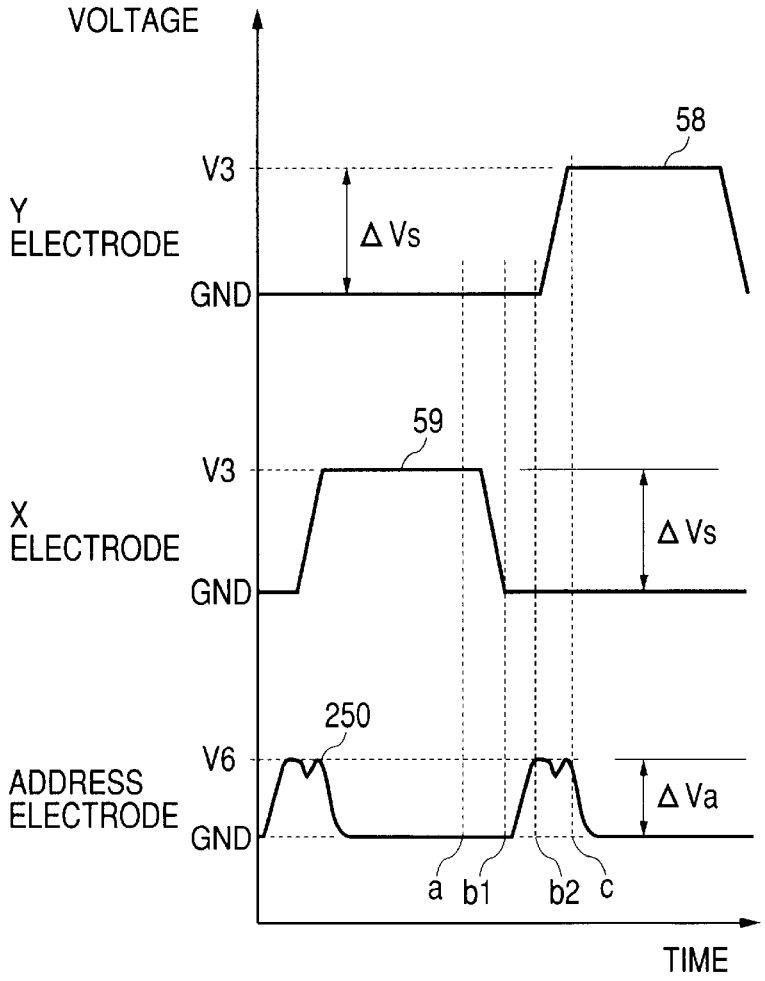
FIG. 14 illustrates voltage waveforms in a driving method in accordance with an embodiment of the present invention.
Figure 15A:
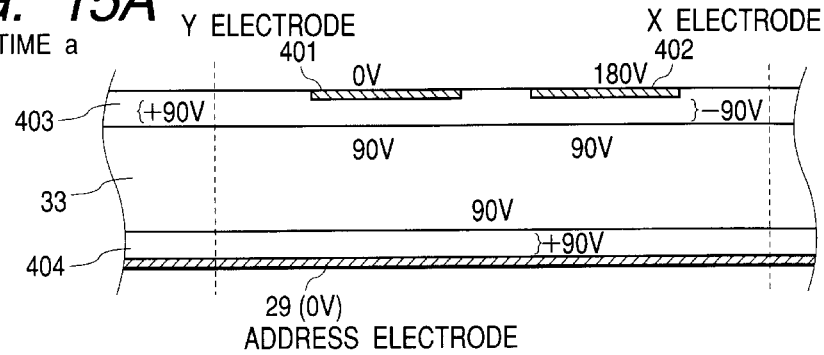
FIGS. 15A, 15B, 15C and 15D illustrate surface potential models of the dielectric at times a, b1, b2 and c indicated in FIG. 14, respectively.
Figure 15B:
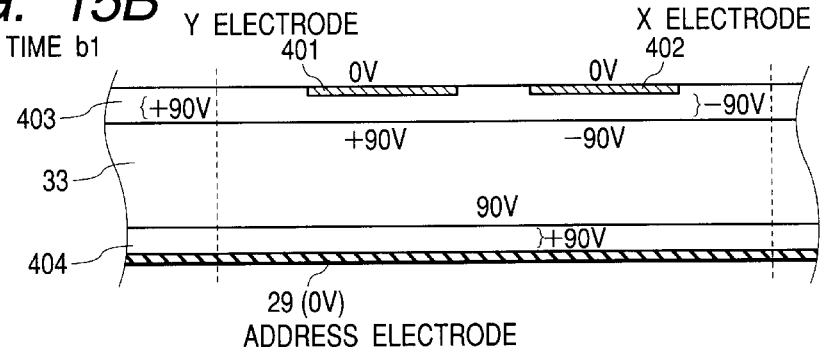
Figure 15C:
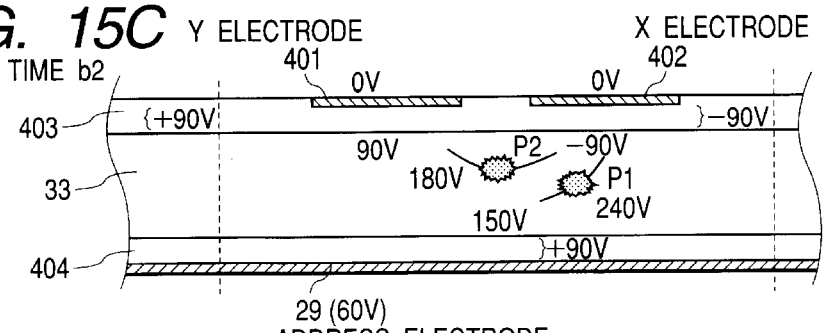
Figure 15D:
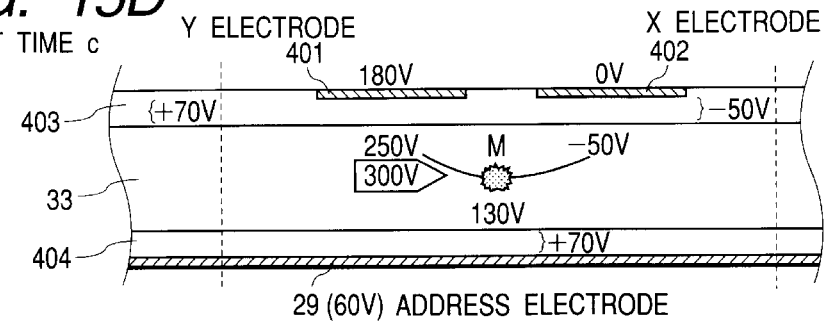

Now FIG. 14 illustrates voltage waveforms in the driving method in accordance with the present embodiment of the present invention, and FIGS. 15A, 15B, 15C and 15D illustrate the surface potential models of the dielectric at times a, b1, b2 and c in FIG. 14, respectively.

Suppose all of the surface potentials on the dielectrics over the Y, X and address electrodes are 90 V at time a, like in the case of the conventional driving method. At this time a, since the voltage on the address electrode is 0V unlike in the case of the conventional driving method, there is generated a wall voltage of 90 V between the address electrode and the surface of the dielectric over the address electrode.

At time b1 during the interval of time, since the voltage on the X electrode changes to 0V, the potential of the surface of the dielectric over the X electrode is −90 V which is a wall voltage portion.

At time b2 during the interval of time, since the voltage on the address electrode changes to 60 V, the potential of the surface of the dielectric over the address electrode changes to 150 V. At this time b2, the potential difference between the two surfaces of the dielectrics over the X and address electrodes becomes 240 V, which is over the discharge start voltage (about 210 V), and consequently, vertical discharge (denoted by reference character P1) is generated between the address and x electrodes. Although the potential difference between the two surfaces of the dielectrics over the X and Y electrodes is 180 V, the surface discharge (denoted by reference character P2) is generated between the two surfaces of the dielectrics over the X and Y electrodes with the aid of the priming effect of the vertical discharge generated between the address and x electrodes.

At time C, the respective wall voltages over the electrodes are lowered as a result of the pre-discharge, as shown in FIG. 14 and FIG. D. On the other hand, since the Y electrode is supplied with a voltage of 180 V, the potential of the surface of the dielectric over the X electrode changes to 250 V. The surface potential of the dielectric over the X electrode is −50 V. Consequently, the potential difference between the two surfaces of the dielectrics over the X and Y electrodes becomes 300 V, which is over the discharge start voltage (about 230 V), and therefore the main discharge (the surface discharge denoted by reference character M) is generated between the two surfaces of the dielectrics over the X and Y electrodes, reinforced by the priming effect of the pre-discharges P1 and P2.

Since all of the discharges P1, P2 and M are generated under lower discharge-space voltage than in the conventional driving method, and the ultraviolet-light-producing efficiency is increased as the discharge-space voltage is lowered, the PDP of the present embodiment increases its luminous efficacy.

As explained above, the pre-discharge is generated which includes a vertical discharge between the sustain-discharge electrodes and the address electrode and a surface discharge between the sustain-discharge electrodes, and then the main discharge is generated with the aid of the priming effect provided by the pre-discharge. Since all of the discharges are generated by the lower discharge-space voltage than in the conventional driving method, the electron temperature is lowered and consequently, the ultraviolet-light-producing efficiency is increased.

The energy of ions impinging on the surface of the dielectric over the X and Y electrodes becomes lower than that in the conventional driving method, and as a result the lifetime of the oxide layer, i.e., the MgO is lengthened.

Further, the present invention and the conventional driving method are compared in terms of the following characteristics.

The following notation is employed:

δjs1max is a maximum value of δjs1(t) during the S3 period, ts1p=an average of two times at which δjs1(t) reaches a value of 0.9×δjs1max first and last, respectively, during the S3 period, or ts1p can be taken as a time at which δjs1max occurs during the S3 period, ts1s is a time at which δjs1(t) reaches 0.05×δjs1max first prior to the time ts1p during the S3 period, and ts1e is a time at which δjs1(t) reaches 0.05×δjs1max first after the time ts1p during the S3 period.

Figures 18, 19A, 19B, 19C:
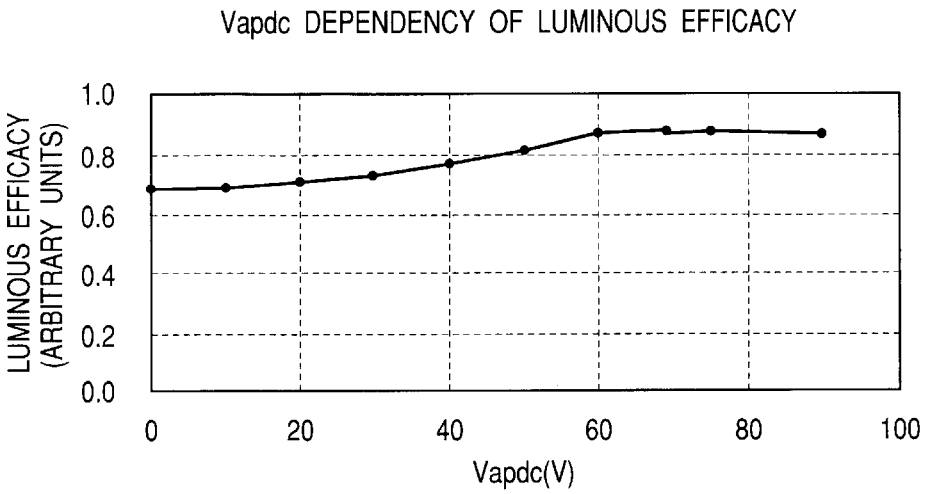
FIG. 18 is graph showing light-emission-period address-electrode pulse-voltage-peak Vapdc dependency of luminous efficacy of the PDP in accordance with the present invention.
FIGS. 19A–19C represent equations used for evaluating the present invent.

The ratio represented by Formula 2 in FIG. 19B was evaluated.

The above-defined ratio for the present embodiment was 2.2, and that for the conventional driving method was 1.2. It was confirmed that the inequality 3 shown in FIG. 19C is one of the features of the present invention.

The ratio of (ts1p-ts1s)/(ts1e-ts1p) was evaluated, this ratio for the present embodiment was 5.2, and that for the conventional driving method was 1.4. It was confirmed that the following inequality is one of the features of the present invention:

$$ts1p-ts1s>2.0\times(ts1e-ts1p).$$

In the discharge cell where the address-discharge has occurred, discharge is started by the first voltage pulse applied to one of the X and Y electrodes, and the discharge continues until wall charges of the opposite polarity accumulate to some extent. The wall voltage accumulated due to this discharge serves to reinforce the second voltage pulse applied to the other of the X and Y electrodes, and then discharge is started again.

The above is repeated by the third, fourth and succeeding pulses.

In this way, in the discharge cell where the address-discharge has occurred, i.e., in the selected discharge cell, sustain-discharges occur between the X and Y electrodes the number of times equal to the number of the applied voltage pulses and thereby emit light. On the other hand, the discharge cells do not emit light where the address-discharge has not occurred. That is to say, even if the voltage 250 is applied to the address electrode 29 during the interval of time 251, the pre-discharge or the main discharge is not generated unless the wall voltage at a cathode over the sustain-discharge electrodes is present which is produced by the address-discharge.

In the present invention, during the vertical discharge between the address electrode and one of a pair of sustain-discharge electrodes in the pre-discharge, the significantly positive δjsa is flowing. In other words, electrons enters the address electrode across the discharge space during the pre-discharge, and therefore no ions bombard the phosphor coated on the address-electrode-side substrate. Further, as shown in FIG. 1C, δjsa goes negative in the vicinity of the time ts1p corresponding to the peak value of δjs1. When this fact is considered, it is thought that ions begin to enter the address electrode, i.e., the phosphor at this time ts1p and neutralize electrons having been accumulated hereto. However, the strong electric fields are concentrated only at the cathode as a cathode fall during the main discharge, and therefore it is thought that the electric fields are weak in the vicinity of the address electrode and ion bombardment is weak, and has little adverse effect of shortening the lifetime of the phosphor.

As explained above, the driving method in accordance with the present invention improves the luminous efficacy and reduces deterioration in lifetime characteristics as compared with the conventional driving method. Further, the driving method of the present invention has another advantage that it is not very different from the conventional driving method.

The peak value Vapdc of a pulse voltage applied on the address electrode (a light-emission-period address-electrode pulse voltage) was selected to be 60 V in this embodiment.

Figure 16:
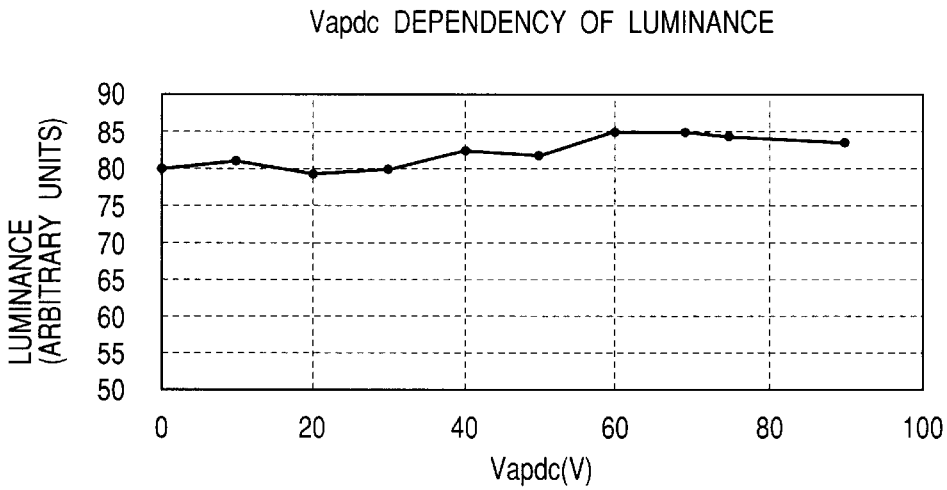
FIG. 16 is graph showing light-emission-period address-electrode pulse-voltage-peak Vapdc dependency of luminance of the PDP in accordance with the present invention.
Figure 17:
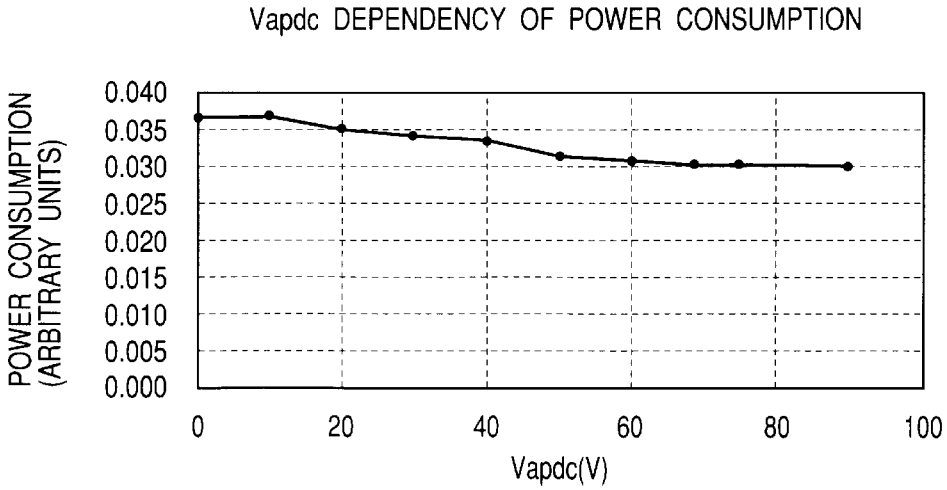
FIG. 17 is graph showing light-emission-period address-electrode pulse-voltage-peak Vapdc dependency of power consumption of the PDP in accordance with the present invention.

FIGS. 16, 17 and 18 show light-emission-period address-electrode pulse-voltage-peak Vapdc dependency of luminance, electric power consumption and luminous efficacy, respectively.

The luminous efficacy begins to increase at Vapdc=about 20 V, becomes approximately constant at Vapdc≧60 V, and ceases to increase. The condition of Vapdc=0 V corresponds to that of the conventional driving method that the address electrode is grounded. The increase in the luminous efficacy by the present invention is differences from the luminous efficacy obtained by the condition of Vapdc=0 V. The luminous efficacy at Vapdc in the range from 60 V to 90 V is increased by about 30% from that at the condition of Vapdc=0 V which corresponds to the conventional driving method. Therefore it was confirmed that the luminous efficacy can be increased at Vapdc in the range from 20 V to 90 V.

The increase in the luminous efficacy at Vapdc in the range from 20 V to 90 V is produced by the increase in the strength of the pre-discharge provided by light-emission-period address-electrode pulse voltage. As the strength of the pre-discharge is increased, the contribution of the pre-discharge to the improvement of the ultraviolet-light-producing efficiency is increased and the ultraviolet-light-producing efficiency of the main discharge is also increased. This is the reason that the luminous efficacy is increased.

However, the peak value Vapdc over 90 V has the disadvantages that the capacitive currents are increased and the load of the address-electrode pulse driving circuit is increased. Further, too strong pre-discharge sometimes extinguishes wall charges accumulated over the sustain-discharge electrodes greatly such that the pre-discharge does not trigger the main discharge, and therefore it is desirable that the peak value Vapdc is selected to be equal to or lower than 90 V. Generally, if the voltage difference ΔVa (see FIG. 14) between the maximum (peak) voltage and the minimum (valley) voltage of the light-emission-period address-electrode pulse voltage applied on the address electrode is in a range from 20 V to 90 V, the advantage of the higher luminous efficacy is obtained.

More generally, the same advantage of the higher luminous efficacy is obtained if the following relationship is satisfied during the light-emission period:

$$Vsaf+70\ V \geqq Vsum \geqq Vsaf,$$

where

Vsum is a sum of a voltage difference ΔVs (see FIG. 14) between maximum (peak) and minimum (valley) values of the discharge-sustaining voltage applied to the respective sustain-discharge electrodes during the light-emission period and a voltage difference ΔVa (see FIG. 14) between maximum (peak) and minimum (valley) values of the light-emission-period address-electrode pulse voltage applied to the address electrode during the light-emission period, and Vsaf is a discharge start voltage at which discharge starts between the address electrode and one of the pair of sustain-discharge electrodes.

The discharge start voltage Vsaf between the address electrode and the sustain-discharge electrode can be measured as follows.

The voltage sequence is repeated in which after all the electrodes are reset, one of a pair of sustain-discharge electrodes is supplied with a voltage of (−Vs) and an address electrode is supplied with a voltage of (+Va). The discharge start voltage Vsaf for the vertical discharge is defined as a voltage value (Vs+Va) at which the first light emission by discharge occurs when the value (Vs+Va) is increased progressively from 0 V in the above voltage sequence. If the two sustain-discharge electrodes constituting one pair are asymmetrical, the above measurement is made separately for each of the X and Y sustain-discharge electrodes, and two discharge start voltages for the vertical discharge are determined for the respective sustain-discharge electrodes.

In this embodiment, the discharge start voltage for the vertical discharge is about 200 V, the following relationship is obtained:

$$200 \leqq \Delta Vs+\Delta Va \leqq 270\ V.$$

When ΔVs=180 V, the above relationship becomes as follows:

$$20 \leqq \Delta Va \leqq 90\ V.$$

As described above, the absolute value ΔVs (see FIG. 14) of the voltage difference between the maximum (peak) and minimum (valley) values of the discharge-sustaining voltage applied to the sustain-discharge electrodes during the light-emission period was selected to be 180 V in the present embodiment. However, if the value ΔVs is selected to be equal to or greater than two-thirds of the discharge start voltage Vsf between the pair of the sustain-discharge electrodes, the same advantages are obtained. That is to say, the vertical discharge can induce the surface discharge between the pair of the sustain-discharge electrodes.

The discharge start voltage Vsf between the pair of the sustain-discharge electrodes is measured as follows:

The discharge start voltage Vsf for the surface discharge is defined as a voltage value ΔVs at which the first light emission by discharge occurs when the value ΔVs is increased progressively from 0 V.

In the following consideration, the below notation is employed:

Vs1s, Vs2s, and Vas are voltages applied to one of the X and Y sustain-discharge electrodes, the other of X and Y sustain-discharge electrodes, and the address electrode, respectively, at a first period during which the X and Y sustain-discharge electrodes have applied thereon pulse voltages equal to one another (the ground level in FIG. 14);

Vs1d, Vs2d, and Vad are voltages applied to the one of the X and Y sustain-discharge electrodes, the other of the X and Y sustain-discharge electrodes, and the address electrodes at a second period, respectively, prior to the first period, during which the X and Y sustain-discharge electrodes have applied thereon pulse voltages different from each other;

ΔVs1 is Vs1s−Vs1d;

ΔVs2 is Vs2s−Vs2d; and

ΔVa is Vas−Vad.

In the present invention the following relationship is satisfied:

$$\Delta Vs1<\Delta Vs2<\Delta Va,$$

In the present embodiment, the following relationship is satisfied:

$$\Delta Vs1(=-180\ V)<\Delta Vs2(=0\ V)<\Delta Va(=60\ V).$$

This condition prevents strong ion bombardment on the phosphor disposed on the address-electrode side.

The light-emission-period address-electrode pulse voltage 250 (see FIG. 1A) has at least two levels of a voltage Vp and (Vp+ΔVa), and this embodiment corresponds to a case where the voltage Vp=0 V, but the same advantages as explained above is obtained even when Vp≠0 V.

In the present embodiment, the light-emission-period address-electrode pulse voltage 250 (see FIG. 1A) is explained as changing in the significantly negative direction, i.e., falling as represented by reference numeral 255, immediately after cessation of the interval of time 251. However, it was confirmed that the luminous efficacy is improved even if the light-emission-period address-electrode pulse voltage 250 is set to change in the significantly negative direction (to fall) within the interval of time 251.

Further, in the present embodiment, the voltages V3 and V6 are explained as positive, the advantages of the present invention are obtained even when the voltages V3 and V6 are selected to negative.

Further, in Embodiment 1, the circuits 209 and 601 are supplied with the voltages and electric power from the two separate power sources 213 and 214, respectively, as shown in FIG. 2, but both the circuits 209 and 601 can be supplied with the voltages and electric power from a common power source to simplify the circuit configuration.

Further, in Embodiment 1, the voltage pulses for the sustain-discharge electrodes and address electrodes are supplied from the active power sources, but it is needless to say that, even when they are supplied from passive elements such as inductance, capacitance and resistance elements, the same advantages as explained above can be obtained.

Embodiment 2

Figure 3A:
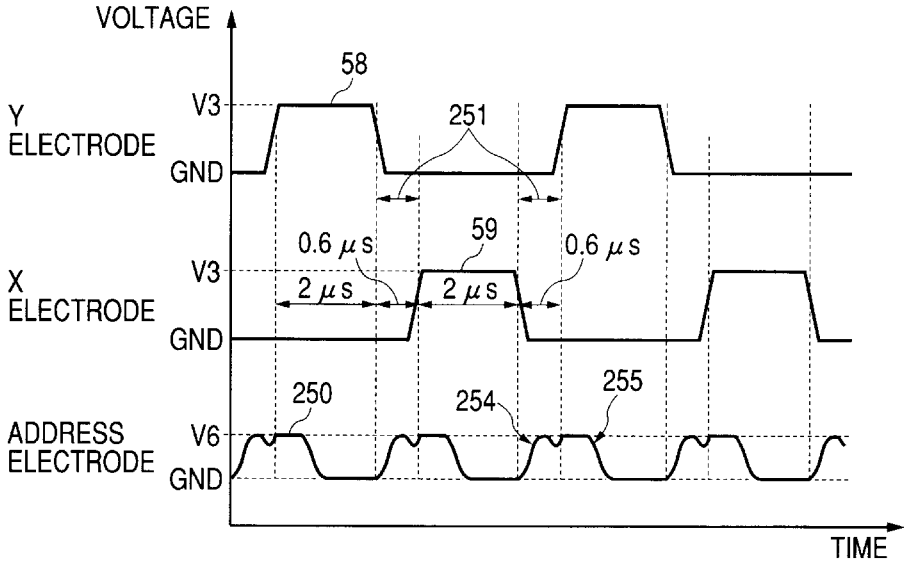
FIG. 3A illustrates a voltage sequence for a PDP of a plasma display device in accordance with an embodiment of the present invention.
Figure 3B:
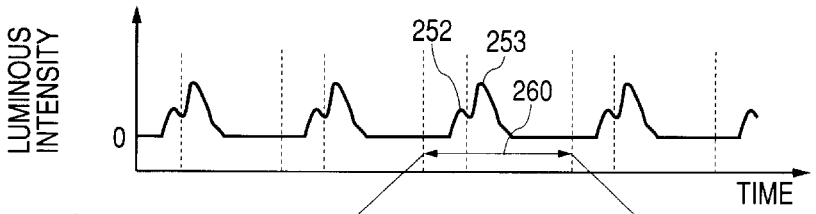
FIG. 3B illustrates a waveform of Xe 823 nm light emission (light emission of 823 nm in wavelength from excited Xe elements)
Figure 3C:
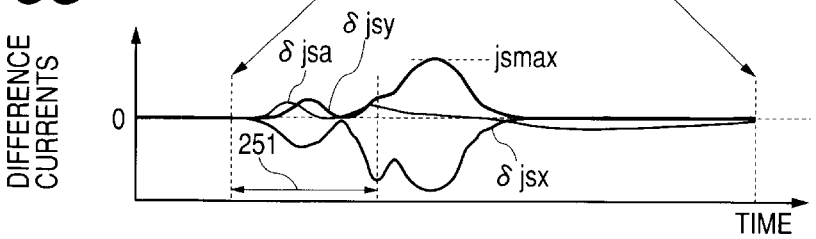
FIG. 3C illustrates waveforms of difference currents in the PDP.

FIG. 3A illustrates a voltage sequence for a PDP of a plasma display device in accordance with Embodiment 2 of the present invention, FIG. 3B illustrates a waveform of Xe 823 nm light emission (light emission of 823 nm in wavelength from excited Xe elements), and FIG. 3C illustrates waveforms of difference currents. The time axes represented on the abscissas are aligned with each other in FIGS.

Figure 4:
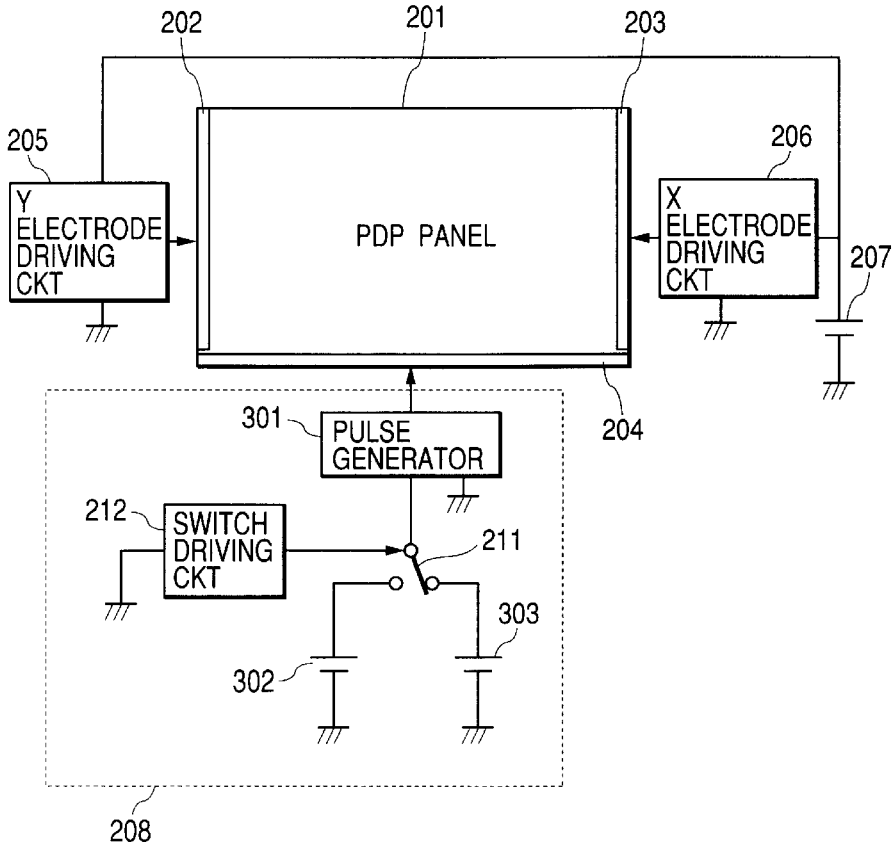
FIG. 4 is a block diagram illustrating a rough configuration of a plasma display device in accordance with an embodiment of the present invention.

3A–3C. FIG. 4 is a block diagram illustrating a rough configuration of the plasma display device in accordance with Embodiment 2 of the present invention.

Embodiment 2 differs from Embodiment 1, in that the light-emission-period address-electrode pulse voltage 250 falls after the main discharge has almost ceased, as indicated by falling denoted by reference numeral 255. In Embodiment 1, the light-emission-period address-electrode pulse voltage 250 begins to fall during the main discharge. This fact can be understood when the voltage changes of the voltage on the address-electrode and the waveforms of luminous intensity shown in FIGS. 1A, 1B, 3A and 3B are considered.

In this embodiment, the following notation is employed:

jsmax1 is a maximum of an absolute value of a current flowing into one of the pair of sustain-discharge electrodes during main discharge;

jsmax2 is a maximum of an absolute value of a current flowing into the other of the pair of sustain-discharge electrodes during the main discharge, jsmax is a larger one of jsmax1 and jsmax2, and thalf is a time at which the absolute value of the current flowing into one of the pair of the sustain-discharge electrodes decreases to 0.5×jsmax, the one of the pair of the sustain-discharge electrodes providing jsmax, after occurrence of the main discharge generated by the discharge-sustaining voltages applied to the sustain-discharge electrodes.

In this Embodiment 2, the light-emission-period address-electrode pulse voltage 250 is selected to change in the negative direction after the time thalf.

As shown in FIG. 4, in the plasma display device in accordance with this embodiment, the address power-source driving section 208 comprises a pulse generator 301, a power source 302 for supplying the address-period address-electrode voltage, a power source 303 for supplying the light-emission-period address-electrode voltage, a switch 211 for switching between the power sources 302 and 303 in specified timing, a switch driving circuit 212 for controlling the switch 211.

This embodiment 2 differs from Embodiment 1, in that the pulse generator 301 is utilized during both the address-discharge period and the light-emission-discharge period, and the switch driving circuit 212 controls the switch 211 between the power sources 302 and 303 for the address-discharge period and the light-emission-discharge period, respectively. This configuration reduces the cost of the plasma display device. The remainder of the configuration is identical to that of Embodiment 1, and their explanation is omitted.

In this embodiment, the light-emission-period address-electrode pulse voltage 250 is configured so as to fall after the main discharge has almost ceased, as indicated by falling denoted by reference numeral 255. As a result, the time of ion bombardment on the phosphor in the discharge space 33 can be shift to the time when the electric field in the space charge has been made further weaker than that in the Embodiment 1, and this provides an advantage of reducing further the damages of the phosphor caused by ion bombardment. Consequently, this embodiment is more advantageous to the luminous efficacy and long lifetime.

The ratios between the light-emissive discharge characteristic values of the present invention and the conventional driving method are as follows.

The discharge electric power ratio is 0.80, the luminance ratio is 1.07, and the luminous-efficacy ratio is 1.35. Therefore it was verified that the present invention improves the luminous efficacy by about 35% compared with the conventional driving method.

As explained above, the electric field during the main discharge is made further weaker than in Embodiment 1, and the ultraviolet-light-producing efficiency is further improve. Color temperature of the PDP is made higher by about 500° C.

The present embodiment is capable of improving the luminous efficacy and raising the color temperature in addition to reducing the cost.

Embodiment 3

Figure 5:
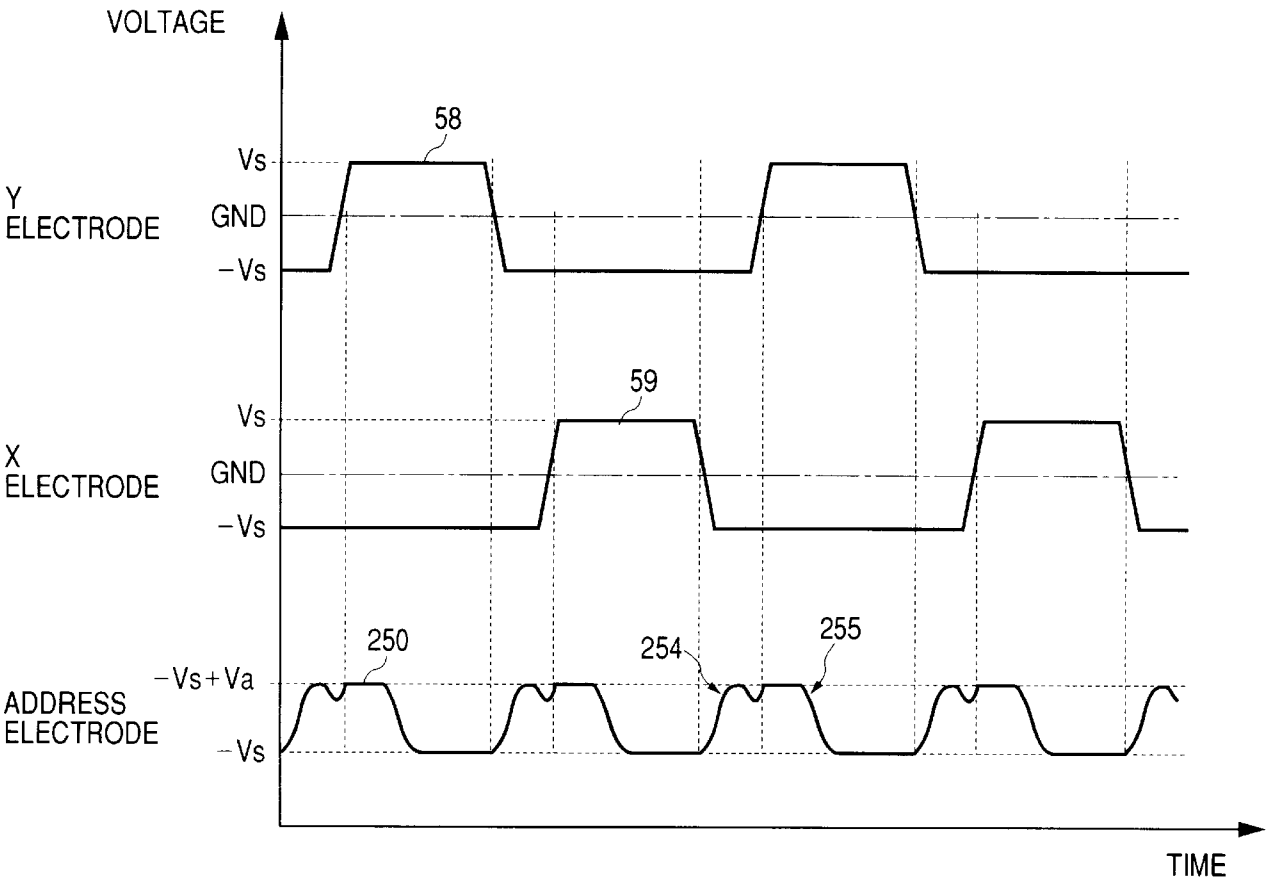
FIG. 5 illustrates a voltage sequence for a PDP of a plasma display device in accordance with an embodiment of the present invention.

FIG. 5 illustrates a voltage sequence for a PDP of a plasma display device in accordance with Embodiment 3 of the present invention. Shown in FIG. 5 is the voltage sequence for the Y, X and address electrodes. This embodiment 3 differs from Embodiment 2 in configuration of application of pulse voltages on the respective electrodes.

As shown in FIG. 5, in this embodiment, the X and Y sustain-discharge electrodes are supplied alternately with pulse voltages of (−Vs level) and pulse voltages of (+Vs level). The two pulse voltages on the X and Y electrodes, respectively, are half the period out of phase with each other, there are periods during which the pulse voltages are at (−Vs level), and these periods are referred to as intervals of time. The light-emission-period address-electrode pulse voltage 250 applied on the address electrode swings approximately between (−Vs) level and (−Vs+Va) level. In this embodiment, improvement on the luminous efficacy was also confirmed as in the previous embodiments.

Further, suppose that the light-emission-period address-electrode pulse voltage 250 swings at least between a voltage approximately (−Vss) and (−Vss+Va), and then the same advantages of increasing the luminous efficacy as explained above is obtained even when Vss≠Vs.

Embodiment 4

Figure 6:
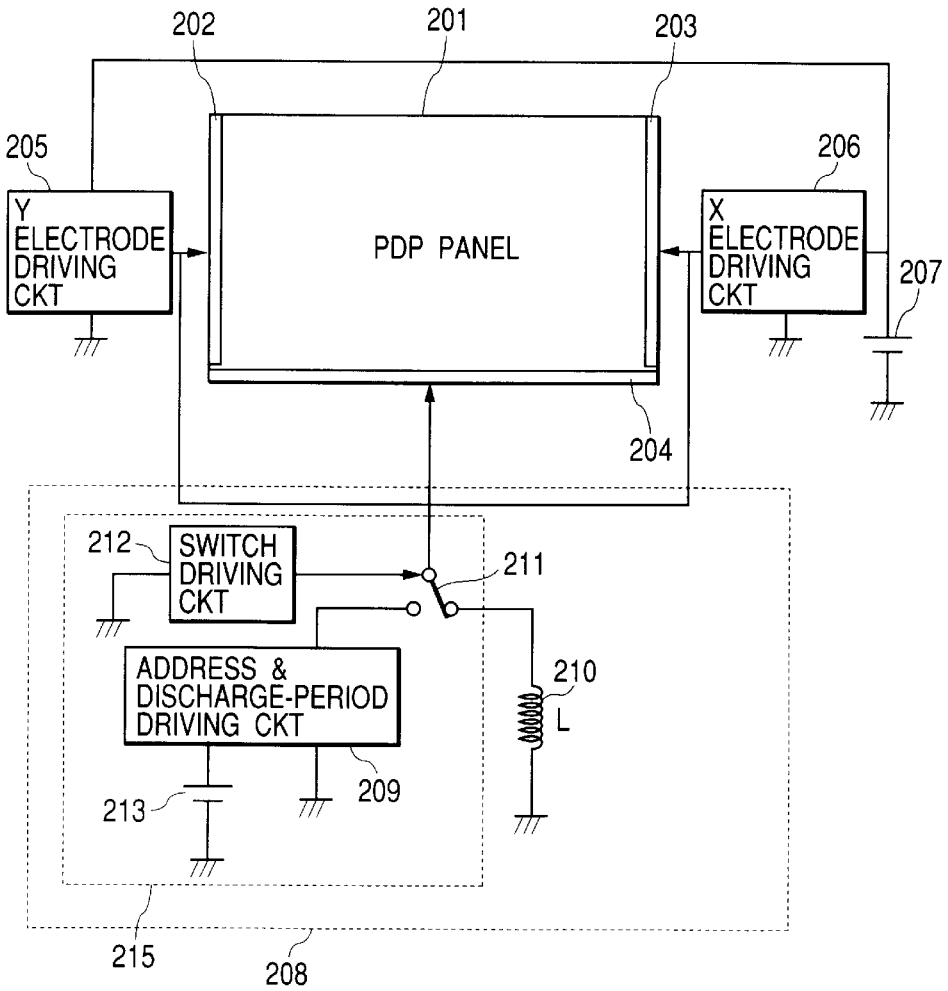
FIG. 6 is a block diagram illustrating a rough configuration of an example of the plasma display device in accordance with the present invention.

FIG. 6 is a block diagram illustrating a rough configuration of an example of the plasma display device in accordance with this embodiment 4 of the present invention. This embodiment differs from Embodiment 1, in that an inductance element (a coil) 210 is coupled instead of the pulse waveform generator 601 and a combination of the switch driving circuit 212 and at least a portion of the address-electrode driving circuit 209 including switching elements for generating light-emission-period address-electrode pulses are fabricated as an integrated circuit 215. The waveforms of the discharge-sustaining pulse voltages applied to the sustain-discharge electrodes are identical to those in Embodiment 1, and their detailed explanation is omitted.

When the inductance element (the coil) 210 is employed, voltages are generated on the address electrode due to ringing caused by the inductance element 210 and capacitances formed by the electrodes of the PDP 201 at the times when the discharge-sustaining pulse voltages applied to the X and Y sustain-discharge electrodes fall (change in the negative direction) and rise (change in the positive direction). In this way, the light-emission-period address-electrode pulses are generated which are similar to those in Embodiments 1 and 2. With this circuit configuration of this embodiment 4, the PDP can be operated like in the case of Embodiment 1, for example. Therefore this embodiment 4 also provides the advantage of improving the luminous efficacy as in the case of the previous embodiments.

Although the inductance element 210 is connected to ground in FIG. 6, the same advantages are obtained even when the inductance element 210 is connected to a fixed-voltage source.

In this way, this embodiment 4 can produce the light-emission-period address-electrode pulses without using the pulse waveform generator, and therefore this embodiment 4 is capable of realizing the higher luminous efficacy at a low cost.

It is needless to say that all of the various possible combinations of the above-described embodiments can be carried out as the present invention.

The present invention has been explained concretely based upon the previous embodiments, but the present invention is not limited to the previous embodiments, and various changes and modifications may be made without departing from the nature and spirit of the invention.

The following summarizes some of the plasma display devices in accordance with the present invention:

(1) A plasma display device including a plasma display panel having a pair of first and second substrates facing each other with a spacing therebetween, and a plurality of discharge cells formed between the pair of first and second substrates, each of the plurality of discharge cells being provided with a pair of discharge-sustaining electrodes disposed on the first substrate, an address electrode disposed to intersect the pair of discharge-sustaining electrodes on the second substrate, a dielectric substance covering the pair of discharge-sustaining electrodes; the plasma display panel driven by including at least address-discharge period for addressing the plurality of discharge cells and thereby inducing address-discharge therein; and light-emission period for applying repetitive discharge-sustaining pulse voltages to at least one of the first and second discharge-sustaining electrodes such that the addressed ones of the plurality of discharge cells start and sustain main discharge depending upon the presence of the address-discharge to generate light for formation of a display, wherein second repetitive pulse voltages are applied to the plurality of address electrodes to generate pre-discharge, the pre-discharge occurs at least during a portion of at least one of intervals of time, the pre-discharge initially occurring between the address electrodes of the addressed ones of the plurality of discharge cells and one of the first and second discharge-sustaining electrodes of the addressed ones, and thereafter occurring between the first and second discharge-sustaining electrodes of the addressed ones, where $t1 \leqq$ the interval of time $\leqq t2$, V3 is a maximum of an absolute value of a voltage difference between the first and second discharge-sustaining electrodes during the light-emission period, S1 periods are each defined as periods which straddle respective valleys of a waveform of the absolute value of the voltage difference, and during which the absolute value of the voltage difference is less than or equal to $0.9 \times V3$, t1 is a time at which each of the S1 periods starts, S2 periods are each defined as periods during which the absolute value of the voltage difference is less than or equal to $0.5 \times V3$ within a respective one of the S1 periods, and t2 is a time at which each of the S2 periods ends.

(2) A plasma display device including a plasma display panel having a pair of first and second substrates facing each other with a spacing therebetween, and a plurality of discharge cells formed between the pair of first and second substrates, each of the plurality of discharge cells being provided with a pair of discharge-sustaining electrodes disposed on the first substrate, an address electrode disposed to intersect the pair of discharge-sustaining electrodes on the second substrate, a dielectric substance covering the pair of discharge-sustaining electrodes; the plasma display panel driven including at least address-discharge period for addressing the plurality of discharge cells and thereby inducing address-discharge therein; and light-emission period for applying repetitive discharge-sustaining pulse voltages to at least one of the first and second discharge-sustaining electrodes such that the addressed ones of the plurality of discharge cells start and sustain main discharge depending upon the presence of the address-discharge to generate light for formation of a display, wherein second repetitive pulse voltages are applied to the plurality of address electrodes to generate pre-discharge, the pre-discharge occurs during intervals of time, the pre-discharge initially occurring between the address electrodes of the addressed ones of the plurality of discharge cells and one of the first and second discharge-sustaining electrodes of the addressed ones, and thereafter occurring between the first and second discharge-sustaining electrodes of the addressed ones, where $t1 \leqq$ the interval of time $\leqq t2$, V3 is a maximum of an absolute value of a voltage difference between the first and second discharge-sustaining electrodes during the light-emission period, S1 periods are each defined as periods which straddle respective valleys of a waveform of the absolute value of the voltage difference, and during which the absolute value of the voltage difference is less than or equal to $0.9 \times V3$, t1 is a time at which each of the S1 periods starts, S2 periods are each defined as periods during which the absolute value of the voltage difference is less than or equal to $0.5 \times V3$ within a respective one of the S1 periods, and t2 is a time at which each of the S2 periods ends, and wherein a difference current flowing into the address electrode of the addressed ones and a difference current flowing into a first one of the pair of discharge-sustaining electrodes of the addressed ones are positive at least during a portion of the interval of time, where the first one of the pair of discharge-sustaining electrodes is at a positive potential with respect to another of the pair of discharge-sustaining electrodes of the addressed ones immediately after the interval of time, the difference current flowing into the address electrode is defined as a current flowing thereinto minus a capacitive current flowing thereinto, the difference current flowing into the first one of the pair of discharge-sustaining electrodes is defined as a current flowing thereinto minus a capacitive currents flowing thereinto, the difference currents are taken as positive when flowing into the address electrode and the first one of the pair of discharge-sustaining electrodes, respectively, from a circuit external to the plasma display panel.

(3) A plasma display device including a plasma display panel having a pair of first and second substrates facing each other with a spacing therebetween, and a plurality of discharge cells formed between the pair of first and second substrates, each of the plurality of discharge cells being provided with a pair of discharge-sustaining electrodes disposed on the first substrate, an address electrode disposed to intersect the pair of discharge-sustaining electrodes on the second substrate, a dielectric substance covering the pair of discharge-sustaining electrodes; the plasma display panel driven including at least address-discharge period for addressing the plurality of discharge cells and thereby inducing address-discharge therein; and light-emission period for applying repetitive discharge-sustaining pulse voltages to at least one of the first and second discharge-sustaining electrodes such that the addressed ones of the plurality of discharge cells start and sustain main discharge depending upon the presence of the address-discharge to generate light for formation of a display, wherein second repetitive pulse voltages are applied to the plurality of address electrodes to generate pre-discharge, the pre-discharge occurs during intervals of time, the pre-discharge initially occurring between the address electrodes of the addressed ones of the plurality of discharge cells and one of the first and second discharge-sustaining electrodes of the addressed ones, and thereafter occurring between the first and second discharge-sustaining electrodes of the addressed ones, where t1≦the interval of time≦t2, V3 is a maximum of an absolute value of a voltage difference between the first and second discharge-sustaining electrodes during the light-emission period, S1 periods are each defined as periods which straddle respective valleys of a waveform of the absolute value of the voltage difference, and during which the absolute value of the voltage difference is less than or equal to 0.9×V3, t1 is a time at which each of the S1 periods starts, S2 periods are each defined as periods during which the absolute value of the voltage difference is less than or equal to 0.5×V3 within a respective one of the S1 periods, and t2 is a time at which each of the S2 periods ends, and wherein initially δjsa(t)>0, and thereafter δjs1(t)>0, at least during a portion of the interval of time, where t represents time, δjs1(t)=js1W(t)−js1B(t), δjsa(t)=jsaW(t)−jsaB(t), a state W is a state where a group comprising specified ones of the plurality of discharge cells is addressed to display a white image, a state B is a state where the group comprising specified ones of the plurality of discharge cells is set to display a black image, leaving the remainder of the plurality of discharge cells unchanged from the state W, js1W(t)=a current flowing into a first one of the pair of discharge-sustaining electrodes of the group in the state W, jsaW(t)=a current flowing into one of the address electrodes of the group in the state W, js1B(t)=a current flowing into the first one of the pair of discharge-sustaining electrodes of the group in the state B, jsaB(t)=a current flowing into one of the address electrodes of the group in the state B, the currents are taken as positive when flowing into corresponding electrodes from a circuit external to the plasma display panel, the first one of the pair of discharge-sustaining electrodes is at a positive potential with respect to the second one of the pair of discharge-sustaining electrodes immediately after the interval of time.

(4) A plasma display device including a plasma display panel having a pair of first and second substrates facing each other with a spacing therebetween, and a plurality of discharge cells formed between the pair of first and second substrates, each of the plurality of discharge cells being provided with a pair of discharge-sustaining electrodes disposed on the first substrate, an address electrode disposed to intersect the pair of discharge-sustaining electrodes on the second substrate, a dielectric substance covering the pair of discharge-sustaining electrodes; the plasma display panel driven including at least address-discharge period for addressing the plurality of discharge cells and thereby inducing address-discharge therein; and light-emission period for applying repetitive discharge-sustaining pulse voltages to at least one of the first and second discharge-sustaining electrodes such that the addressed ones of the plurality of discharge cells start and sustain main discharge depending upon the presence of the address-discharge to generate light for formation of a display, wherein second repetitive pulse voltages are applied to the plurality of address electrodes to generate pre-discharge, the pre-discharge occurs during intervals of time, the pre-discharge initially occurring between the address electrodes of the addressed ones of the plurality of discharge cells and one of the first and second discharge-sustaining electrodes of the addressed ones, and thereafter occurring between the first and second discharge-sustaining electrodes of the addressed ones, where t1≦the interval of time≦t2, V3 is a maximum of an absolute value of a voltage difference between the first and second discharge-sustaining electrodes during the light-emission period, S1 periods are each defined as periods which straddle respective valleys of a waveform of the absolute value of the voltage difference, and during which the absolute value of the voltage difference is less than or equal to 0.9×V3, t1 is a time at which each of the S1 periods starts, S2 periods are each defined as periods during which the absolute value of the voltage difference is less than or equal to 0.5×V3 within a respective one of the S1 periods, and t2 is a time at which each of the S2 periods ends, and wherein the following relationship is satisfied during the interval of time: Js(first half)>1.5×Js(second half), where Js(first half) is an integral from time tposi to time ts1p of a difference current flowing into a first one of the pair of discharge-sustaining electrodes, Js(second half) is an integral from the time ts1p to time tzero of the difference current, the first one of the pair of discharge-sustaining electrodes is at a positive potential with respect to another of the pair of discharge-sustaining electrodes immediately after the interval of time, the difference current is defined as a current flowing into the first one of the pair of discharge-sustaining electrodes minus a capacitive current flowing thereinto, the currents are taken as positive when flowing into the first one of the pair of discharge-sustaining electrodes from a circuit external to the plasma display panel, t1a is a time at which an absolute value of a voltage difference between the pair of discharge-sustaining electrodes decreases to 0.9×V3 first after the S1 period during the light-emission period, S3 period is defined as a period from the time t1 to the time t1a, ts1p is a time at which a maximum of an absolute value of the difference current occurs during the S3 period, tposi is a time at which the difference current reaches a significantly positive value during the S3 period, and tzero is a time at which the difference current reaches a significantly zero value during the S3 period.

(5) A plasma display device including a plasma display panel having a pair of first and second substrates facing each other with a spacing therebetween, and a plurality of discharge cells formed between the pair of first and second substrates, each of the plurality of discharge cells being provided with a pair of discharge-sustaining electrodes disposed on the first substrate, an address electrode disposed to intersect the pair of discharge-sustaining electrodes on the second substrate, a dielectric substance covering the pair of discharge-sustaining electrodes; the plasma display panel driven including at least address-discharge period for addressing the plurality of discharge cells and thereby inducing address-discharge therein; and light-emission period for applying repetitive discharge-sustaining pulse voltages to at least one of the first and second discharge-sustaining electrodes such that the addressed ones of the plurality of discharge cells start and sustain main discharge depending upon the presence of the address-discharge to generate light for formation of a display, wherein second repetitive pulse voltages are applied to the plurality of address electrodes to generate pre-discharge, the pre-discharge occurs during intervals of time, the pre-discharge initially occurring between the address electrodes of the addressed ones of the plurality of discharge cells and one of the first and second discharge-sustaining electrodes of the addressed ones, and thereafter occurring between the first and second discharge-sustaining electrodes of the addressed ones, where t1≦the interval of time≦t2, V3 is a maximum of an absolute value of a voltage difference between the first and second discharge-sustaining electrodes during the light-emission period, S1 periods are each defined as periods which straddle respective valleys of a waveform of the absolute value of the voltage difference, and during which the absolute value of the voltage difference is less than or equal to 0.9×V3, t1 is a time at which each of the S1 periods starts, S2 periods are each defined as periods during which the absolute value of the voltage difference is less than or equal to 0.5×V3 within a respective one of the S1 periods, and t2 is a time at which each of the S2 periods ends, and wherein the following relationship is satisfied during the S period: JS1(first half) >1.5×JS1(second half), where JS1(first half) is an integral from time ts1s to time ts1p of a function$\delta$js1(t) of t, JS1(second half) is an integral from the time ts1p to time ts1e of the function$\delta$js1(t) of t, $\delta$js1(t)=js1W(t)−js1B(t), a state W is a state where a group comprising specified ones of the plurality of discharge cells is addressed to display a white image, a state B is a state where the group comprising specified ones of the plurality of discharge cells is set to display a black image, leaving the remainder of the plurality of discharge cells unchanged from the state W, js1W(t)=a current flowing into a first one of the pair of discharge-sustaining electrodes of the group in the state W, js1B(t)=a current flowing into the first one of the pair of discharge-sustaining electrodes of the group in the state B, the first one of the pair of discharge-sustaining electrodes is at a positive potential with respect to another of the pair of discharge-sustaining electrodes immediately after the interval of time, the currents are taken as positive when flowing into corresponding electrodes from a circuit external to the plasma display panel, t1a is a time at which an absolute value of a voltage difference between the pair of discharge-sustaining electrodes decreases to 0.9×V3 first after the time t2 during the light-emission period, S3 period is defined as a period from the time t1 to the time t1a, $\delta$js1max is a maximum value of $\delta$js1(t) during the S3 period, ts1p=an average of two times at which $\delta$js1(t) reaches a value of 0.9×$\delta$js1max first and last, respectively, during the S3 period, ts1s is a time at which $\delta$js1(t) reaches 0.05×$\delta$js1max first prior to the time ts1p during the S3 period, and ts1e is a time at which $\delta$js1(t) reaches 0.05×$\delta$js1max first after the time ts1p during the S3 period.

(6) A plasma display device including a plasma display panel having a pair of first and second substrates facing each other with a spacing therebetween, and a plurality of discharge cells formed between the pair of first and second substrates, each of the plurality of discharge cells being provided with a pair of discharge-sustaining electrodes disposed on the first substrate, an address electrode disposed to intersect the pair of discharge-sustaining electrodes on the second substrate, a dielectric substance covering the pair of discharge-sustaining electrodes; the plasma display panel driven including at least address-discharge period for addressing the plurality of discharge cells and thereby inducing address-discharge therein; and light-emission period for applying repetitive discharge-sustaining pulse voltages to at least one of the first and second discharge-sustaining electrodes such that the addressed ones of the plurality of discharge cells start and sustain main discharge depending upon the presence of the address-discharge to generate light for formation of a display, wherein second repetitive pulse voltages are applied to the plurality of address electrodes to generate pre-discharge, the pre-discharge occurs during intervals of time, the pre-discharge initially occurring between the address electrodes of the addressed ones of the plurality of discharge cells and one of the first and second discharge-sustaining electrodes of the addressed ones, and thereafter occurring between the first and second discharge-sustaining electrodes of the addressed ones, where t1≦the interval of time≦t2, V3 is a maximum of an absolute value of a voltage difference between the first and second discharge-sustaining electrodes during the light-emission period, S1 periods are each defined as periods which straddle respective valleys of a waveform of the absolute value of the voltage difference, and during which the absolute value of the voltage difference is less than or equal to 0.9×V3, t1 is a time at which each of the S1 periods starts, S2 periods are each defined as periods during which the absolute value of the voltage difference is less than or equal to 0.5×V3 within a respective one of the S1 periods, and t2 is a time at which each of the S2 periods ends, and wherein the following relationship is satisfied: T(first half)>2×T(second half), where T(first half) is defined as a period from time tposi to time ts1p, T(second half) is defined as a period from the time ts1p to time tzero, a difference current is defined as a current flowing into a first one of the pair of discharge-sustaining electrodes minus a capacitive currents flowing thereinto, the first one of the pair of discharge-sustaining electrodes is at a positive potential with respect to another of the pair of discharge-sustaining electrodes immediately after the interval of time, the currents are taken as positive when flowing into the first one of the pair of discharge-sustaining electrodes from a circuit external to the plasma display panel, t1a is a time at which an absolute value of a voltage difference between the pair of discharge-sustaining electrodes decreases to 0.9×V3 first after the S1 period during the light-emission period, S3 period is defined as a period from the time t1 to the time t1a, ts1p is a time at which a maximum of an absolute value of the difference current occurs during the S3 period, tposi is a time at which the difference current reaches a significantly positive value during the S3 period, and tzero is a time at which the difference current reaches a significantly zero value during the S3 period.

(7) A plasma display device including a plasma display panel having a pair of first and second substrates facing each other with a spacing therebetween, and a plurality of discharge cells formed between the pair of first and second substrates, each of the plurality of discharge cells being provided with a pair of discharge-sustaining electrodes disposed on the first substrate, an address electrode disposed to intersect the pair of discharge-sustaining electrodes on the second substrate, a dielectric substance covering the pair of discharge-sustaining electrodes; the plasma display panel driven including at least address-discharge period for addressing the plurality of discharge cells and thereby inducing address-discharge therein; and light-emission period for applying repetitive discharge-sustaining pulse voltages to at least one of the first and second discharge-sustaining electrodes such that the addressed ones of the plurality of discharge cells start and sustain main discharge depending upon the presence of the address-discharge to generate light for formation of a display, wherein second repetitive pulse voltages are applied to the plurality of address electrodes to generate pre-discharge, the pre-discharge occurs during intervals of time, the pre-discharge initially occurring between the address electrodes of the addressed ones of the plurality of discharge cells and one of the first and second discharge-sustaining electrodes of the addressed ones, and thereafter occurring between the first and second discharge-sustaining electrodes of the addressed ones, where t1≦the interval of time≦t2, V3 is a maximum of an absolute value of a voltage difference between the first and second discharge-sustaining electrodes during the light-emission period, S1 periods are each defined as periods which straddle respective valleys of a waveform of the absolute value of the voltage difference, and during which the absolute value of the voltage difference is less than or equal to 0.9×V3, t1 is a time at which each of the S1 periods starts, S2 periods are each defined as periods during which the absolute value of the voltage difference is less than or equal to 0.5×V3 within a respective one of the S1 periods, and t2 is a time at which each of the S2 periods ends, and wherein the following relationship is satisfied: ts1p−ts1s>2×(ts1e−ts1p), where δjs1(t)=js1W(t)−js1B(t), a state W is a state where a group comprising specified ones of the plurality of discharge cells is addressed to display a white image, a state B is a state where the group comprising specified ones of the plurality of discharge cells is set to display a black image, leaving the remainder of the plurality of discharge cells unchanged from the state W, js1W(t)=a current flowing into a first one of the pair of discharge-sustaining electrodes of the group in the state W, js1B(t)=a current flowing into the first one of the pair of discharge-sustaining electrodes of the group in the state B, the first one of the pair of discharge-sustaining electrodes is at a positive potential with respect to another of the pair of discharge-sustaining electrodes immediately after the interval of time, the currents are taken as positive when flowing into corresponding electrodes from a circuit external to the plasma display panel, t1a is a time at which an absolute value of a voltage difference between the pair of discharge-sustaining electrodes decreases to 0.9×V3 first after the S1 period during the light-emission period, S3 period is defined as a period from the time t1 to the time t1a, δjs1max is a maximum value of δjs1(t) during the S3 period, ts1p=an average of two times at which δjs1(t) reaches a value of 0.9×δjs1max first and last, respectively, during the S3 period, ts1s is a time at which δjs1(t) reaches 0.05×δjs1max first prior to the time ts1p during the S3 period, and ts1e is a time at which δjs1(t) reaches 0.05×δjs1max first after the time ts1p during the S3 period.

(8) A plasma display device including a plasma display panel having a pair of first and second substrates facing each other with a spacing therebetween, and a plurality of discharge cells formed between the pair of first and second substrates, each of the plurality of discharge cells being provided with a pair of first and second discharge-sustaining electrodes disposed on the first substrate, an address electrode disposed to intersect the pair of first and second discharge-sustaining electrodes on the second substrate, a dielectric substance covering the pair of first and second discharge-sustaining electrodes; the plasma display panel driven including at least address-discharge period for addressing the plurality of discharge cells and thereby inducing address-discharge therein; and light-emission period for applying repetitive discharge-sustaining pulse voltages to at least one of the pair of first and second discharge-sustaining electrodes such that the addressed ones of the plurality of discharge cells start and sustain main discharge depending upon the presence of the address-discharge to generate light for formation of a display, wherein an address voltage comprised of second repetitive pulse voltages is applied to the plurality of address electrodes to generate pre-discharge, the second repetitive pulse voltages changing toward a positive value during at least a portion of an interval of time, the pre-discharge initially occurring between the address electrodes of the addressed ones of the plurality of discharge cells and one of first and second the discharge-sustaining electrodes of the addressed ones, and thereafter occurring between the pair of first and second discharge-sustaining electrodes of the addressed ones, where t1≦the interval of time≦t2, V3 is a maximum of an absolute value of a voltage difference between the first and second discharge-sustaining electrodes during the light-emission period, S1 periods are each defined as periods which straddle respective valleys of a waveform of the absolute value of the voltage difference, and during which the absolute value of the voltage difference is less than or equal to 0.9×V3, t1 is a time at which each of the S1 periods starts, S2 periods are each defined as periods during which the absolute value of the voltage difference is less than or equal to 0.5×V3 within a respective one of the S1 periods, and t2 is a time at which each of the S2 periods ends.

(9) The plasma display device defined in (8) wherein a voltage difference between maximum and minimum values of the address voltage during at least a portion of the interval of time is in a range from 20 V to 90 V.

(10) The plasma display device defined in (8) wherein the address voltage changes in the negative direction after time thalf, where jsmax1 is a maximum of an absolute value of a current flowing into one of the pair of first and second discharge-sustaining electrodes during main discharge occurring in the interval of time or thereafter, jsmax2 is a maximum of an absolute value of a current flowing into another of the pair of first and second discharge-sustaining electrodes during the main discharge, jsmax is a larger one of jsmax1 and jsmax2, and thalf is a time at which the absolute value of the current flowing into one of the pair of first and second discharge-sustaining electrodes decreases to 0.5×jsmax, the one of the pair of first and second discharge-sustaining electrodes providing jsmax.

(11) The plasma display device defined in (8) wherein the following relationship is satisfied during the light-emission period: Vsaf+70 V≧Vsum≧Vsaf, where Vsum is a sum of an absolute value of a voltage difference between maximum and minimum values of the discharge-sustaining voltages during the light-emission period and an absolute value of a voltage difference between maximum and minimum values of the address voltage during the light-emission period, and Vsaf is a voltage at which discharge starts between the address electrode and one of the pair of first and second discharge-sustaining electrodes.

(12) The plasma display device defined in (8) wherein the following relationship is satisfied during the light-emission period: Vabs≧⅔ Vsf, where Vabs is an absolute value of a voltage difference between maximum and minimum values of the discharge-sustaining voltages, and Vsf is a voltage at which discharge starts between the pair of first and second discharge-sustaining electrodes.

(13) The plasma display device defined in (8) wherein the following relationship is satisfied during the light-emission period: ΔVs1<ΔVs2<ΔVa, where Vs1s, Vs2s, and Vas are voltages applied to one of the pair of first and second discharge-sustaining electrodes, another of the pair of first and second discharge-sustaining electrodes, and the plurality of address electrodes, respectively, at a first period during which the pair of first and second discharge-sustaining electrodes have applied thereon voltages equal to one another, Vs1d, Vs2d, and Vad are voltages applied to the one of the pair of first and second discharge-sustaining electrodes, the another of the pair of first and second discharge-sustaining electrodes, and the plurality of address electrodes at a second period, respectively, prior to the first period, during which the pair of discharge-sustaining electrodes have applied thereon voltages different from each other, ΔVs1 is Vs1s−Vs1d, ΔVs2 is Vs2s−Vs2d, and ΔVa is Vas−Vad.

(14) The plasma display device defined in (8) wherein two pulse voltages applied to the pair of the discharge-sustaining electrodes, respectively, have at least two levels of 0 V and Vs V during the light-emission period, the two pulse voltages are half their repetitive period out of phase with each other, and the two pulse voltages have a time during which the two pulse voltages are at 0 V level at the same time, and a pulse voltage applied to the address electrodes during the light-emission period has at least two levels of Vp V and (Vp+Va) V.

(15) The plasma display device defined in (14) wherein the Vp level is 0 V.

(16) The plasma display device defined in (8) wherein two pulse voltages applied to the pair of the discharge-sustaining electrodes, respectively, have at least two levels of (−Vs) V and (+Vs) V during the light-emission period, the two pulse voltages are half their repetitive period out of phase with each other, and the two pulse voltages have a time during which the two pulse voltages are at (−Vs) V level at the same time, and a pulse voltage applied to the address electrodes during the light-emission period has at least two levels of (−Vss) V and (−Vss+Va) V.

(17) The plasma display device defined in (16) wherein the (−Vss) is approximately equal to (−Vs).

(18) The plasma display device defined in (8) wherein the two kinds of the pulse voltages applied to the address electrodes during the address-discharge period and the light-emission period, respectively, are supplied by two circuits, respectively, which share at least a portion of the two circuits.

(19) The plasma display device defined in (8) wherein the two kinds of the pulse voltages applied to the address electrodes during the address-discharge period and the light-emission period, respectively, are supplied by two circuits, respectively, which share at least a portion of their power sources.

(20) The plasma display device defined in one of (1) to (8) wherein the address electrodes are coupled to a fixed potential or a ground potential via an integrated circuit including a plurality of switching elements for generating the address-discharge pulse voltages, and an inductance element is coupled between the integrated circuit and the fixed potential or the ground potential.

The present invention provides a method of driving the PDP capable of increasing its the luminous efficacy, and also provides a plasma display device capable of the higher luminous efficacy.

What is claimed is:

1. A method of driving a plasma display device having a plasma display panel including a plurality of pairs of first and second discharge-sustaining electrodes, a plurality of address electrodes arranged to intersect said plurality of pairs of first and second discharge-sustaining electrodes, a dielectric substance covering said plurality of pairs of first and second discharge-sustaining electrodes, and a plurality of discharge cells defined by said plurality of pairs of first and second discharge-sustaining electrodes and said plurality of address electrodes;

said method including at least address-discharge period for addressing said plurality of discharge cells and thereby inducing address-discharge therein; and light-emission period for applying repetitive discharge-sustaining pulse voltages to at least one of said first and second discharge-sustaining electrodes such that said addressed ones of said plurality of discharge cells start and sustain main discharge depending upon the presence of said address-discharge to generate light for formation of a display wherein second repetitive pulse voltages are applied to said plurality of address electrodes to generate pre-discharge, said pre-discharge initially occurring between said address electrodes of said addressed ones of said plurality of discharge cells and one of said first and second discharge-sustaining electrodes of said addressed ones, and thereafter occurring between said first and second discharge-sustaining electrodes of said addressed ones, and said second repetitive pulse voltages rise in portions of said light-emission period during which an absolute value of a voltage difference between said pair of first and second discharge-sustaining electrodes does not exceed 0.9×a maximum of an absolute value of a voltage difference between said pair of first and second discharge-sustaining electrodes during said light-emission period.

2. A method of driving a plasma display device including a plasma display panel having a plurality of discharge cells, each of said plurality of discharge cells being provided with a pair of discharge-sustaining electrodes, an address electrode disposed to intersect said pair of discharge-sustaining electrodes, and a dielectric substance covering said pair of discharge-sustaining electrodes;

said method including at least address-discharge period for addressing said plurality of discharge cells and thereby inducing address-discharge therein; and light-emission period for applying repetitive discharge-sustaining pulse voltages to at least one of said first and second discharge-sustaining electrodes such that said addressed ones of said plurality of discharge cells start and sustain main discharge depending upon the presence of said address-discharge to generate light for formation of a display, wherein second repetitive pulse voltages are applied to said plurality of address electrodes to generate pre-discharge, said pre-discharge occurs at least during a portion of at least one of intervals of time, said pre-discharge initially occurring between said address electrodes of said addressed ones of said plurality of discharge cells and one of said first and second discharge-sustaining electrodes of said addressed ones, and thereafter occurring between said first and second discharge-sustaining electrodes of said addressed ones, where $t1 \leqq$ said interval of time $\leqq t2$, V3 is a maximum of an absolute value of a voltage difference between said first and second discharge-sustaining electrodes during said light-emission period, S1 periods are each defined as periods which straddle respective valleys of a waveform of said absolute value of said voltage difference, and during which said absolute value of said voltage difference is less than or equal to 0.9×V3, t1 is a time at which each of said S1 periods starts, S2 periods are each defined as periods during which said absolute value of said voltage difference is less than or equal to 0.5×V3 within a respective one of said S1 periods, and t2 is a time at which each of said S2 periods ends.

3. A method of driving a plasma display device including a plasma display panel having a plurality of discharge cells, each of said plurality of discharge cells being provided with a pair of discharge-sustaining electrodes, an address electrode disposed to intersect said pair of discharge-sustaining electrodes, and a dielectric substance covering said pair of discharge-sustaining electrodes;

said method including at least address-discharge period for addressing said plurality of discharge cells and thereby inducing address-discharge therein; and light-emission period for applying repetitive discharge-sustaining pulse voltages to at least one of said first and second discharge-sustaining electrodes such that said addressed ones of said plurality of discharge cells start and sustain main discharge depending upon the presence of said address-discharge to generate light for formation of a display, wherein second repetitive pulse voltages are applied to said plurality of address electrodes to generate pre-discharge, said pre-discharge occurs during intervals of time, said pre-discharge initially occurring between said address electrodes of said addressed ones of said plurality of discharge cells and one of said first and second discharge-sustaining electrodes of said addressed ones, and thereafter occurring between said first and second discharge-sustaining electrodes of said addressed ones, where t1≦said interval of time≦t2, V3 is a maximum of an absolute value of a voltage difference between said first and second discharge-sustaining electrodes during said light-emission period, S1 periods are each defined as periods which straddle respective valleys of a waveform of said absolute value of said voltage difference, and during which said absolute value of said voltage difference is less than or equal to 0.9×V3, t1 is a time at which each of said S1 periods starts, S2 periods are each defined as periods during which said absolute value of said voltage difference is less than or equal to 0.5×V3 within a respective one of said S1 periods, and t2 is a time at which each of said S2 periods ends.

4. A method of driving a plasma display device according to claim 3, wherein a difference current flowing into said address electrode of said addressed ones and a difference current flowing into a first one of said pair of discharge-sustaining electrodes of said addressed ones are positive at least during a portion of said interval of time, where said first one of said pair of discharge-sustaining electrodes is at a positive potential with respect to another of said pair of discharge-sustaining electrodes of said addressed ones immediately after said interval of time, said difference current flowing into said address electrode is defined as a current flowing thereinto minus a capacitive current flowing thereinto, said difference current flowing into said first one of said pair of discharge-sustaining electrodes is defined as a current flowing thereinto minus a capacitive currents flowing thereinto, said difference currents are taken as positive when flowing into said address electrode and said first one of said pair of discharge-sustaining electrodes, respectively, from a circuit external to said plasma display panel.

5. A method of driving a plasma display device according to claim 3, wherein initially δjsa(t)>0, and thereafter δjs1(t)>0, at least during a portion of said interval of time, where t represents time, $$\delta js1(t)=js1W(t)-js1B(t),$$

$$\delta jsa(t)=jsaW(t)-jsaB(t),$$

a state W is a state where a group comprising specified ones of said plurality of discharge cells is addressed to display a white image, a state B is a state where said group comprising specified ones of said plurality of discharge cells is set to display a black image, leaving the remainder of said plurality of discharge cells unchanged from said state W, js1W(t)=a current flowing into a first one of said pair of discharge-sustaining electrodes of said group in said state W, jsaW(t)=a current flowing into one of said address electrodes of said group in said state W, js1B(t)=a current flowing into said first one of said pair of discharge-sustaining electrodes of said group in said state B, jsaB(t)=a current flowing into one of said address electrodes of said group in said state B, said currents are taken as positive when flowing into corresponding electrodes from a circuit external to said plasma display panel, said first one of said pair of discharge-sustaining electrodes is at a positive potential with respect to said second one of said pair of discharge-sustaining electrodes immediately after said interval of time.

6. A method of driving a plasma display device according to claim 3, wherein the following relationship is satisfied during said interval of time:

$$Js(\text{first half})>1.5\times Js(\text{second half}),$$

where

Js(first half) is an integral from time tposi to time ts1p of a difference current flowing into a first one of said pair of discharge-sustaining electrodes, Js(second half) is an integral from the time ts1p to time tzero of said difference current, said first one of said pair of discharge-sustaining electrodes is at a positive potential with respect to another of said pair of discharge-sustaining electrodes immediately after said interval of time, said difference current is defined as a current flowing into said first one of said pair of discharge-sustaining electrodes minus a capacitive current flowing thereinto, said currents are taken as positive when flowing into said first one of said pair of discharge-sustaining electrodes from a circuit external to said plasma display panel, t1a is a time at which an absolute value of a voltage difference between said pair of discharge-sustaining electrodes decreases to 0.9×V3 first after said S1 period during said light-emission period, S3 period is defined as a period from the time t1 to the time t1a, ts1p is a time at which a maximum of an absolute value of said difference current occurs during said S3 period, tposi is a time at which said difference current reaches a significantly positive value during said S3 period, and tzero is a time at which said difference current reaches a significantly zero value during said S3 period.

7. A method of driving a plasma display device according to claim 3, wherein the following relationship is satisfied during said S1 period:

$$JS1(\text{first half})>1.5\times JS1(\text{second half}),$$

where

JS1(first half) is an integral from time ts1s to time ts1p of a function δjs1(t) of t, JS1(second half) is an integral from the time ts1p to time ts1e of the function δjs1(t) of t, $$\delta js1(t)=js1W(t)-js1B(t),$$

a state W is a state where a group comprising specified ones of said plurality of discharge cells is addressed to display a white image, a state B is a state where said group comprising specified ones of said plurality of discharge cells is set to display a black image, leaving the remainder of said plurality of discharge cells unchanged from said state W, js1W(t)=a current flowing into a first one of said pair of discharge-sustaining electrodes of said group in said state W, js1B(t)=a current flowing into said first one of said pair of discharge-sustaining electrodes of said group in said state B, said first one of said pair of discharge-sustaining electrodes is at a positive potential with respect to another of said pair of discharge-sustaining electrodes immediately after said interval of time, said currents are taken as positive when flowing into corresponding electrodes from a circuit external to said plasma display panel, t1a is a time at which an absolute value of a voltage difference between said pair of discharge-sustaining electrodes decreases to 0.9×V3 first after the time t2 during said light-emission period, S3 period is defined as a period from the time t1 to the time t1a, δjs1max is a maximum value of δjs1(t) during said S3 period, ts1p=an average of two times at which δjs1(t) reaches a value of 0.9×δjs1max first and last, respectively, during said S3 period, ts1s is a time at which δjs1(t) reaches 0.05×δjs1max first prior to the time ts1p during the S3 period, and ts1e is a time at which δjs1(t) reaches 0.05×δjs1max first after the time ts1p during said S3 period.

8. A method of driving a plasma display device according to claim 3, wherein the following relationship is satisfied:

$$T(\text{first half})>2\times T(\text{second half}),$$

where

T(first half) is defined as a period from time tposi to time ts1p,

T(second half) is defined as a period from the time ts1p to time tzero, a difference current is defined as a current flowing into a first one of said pair of discharge-sustaining electrodes minus a capacitive currents flowing thereinto, said first one of said pair of discharge-sustaining electrodes is at a positive potential with respect to another of said pair of discharge-sustaining electrodes immediately after said interval of time, said currents are taken as positive when flowing into said first one of said pair of discharge-sustaining electrodes from a circuit external to said plasma display panel, t1a is a time at which an absolute value of a voltage difference between said pair of discharge-sustaining electrodes decreases to 0.9×V3 first after said S1 period during said light-emission period, S3 period is defined as a period from the time t1 to the time t1a, ts1p is a time at which a maximum of an absolute value of said difference current occurs during said S3 period, tposi is a time at which said difference current reaches a significantly positive value during said S3 period, and tzero is a time at which said difference current reaches a significantly zero value during said S3 period.

9. A method of driving a plasma display device according to claim 3, wherein the following relationship is satisfied:

$$ts1p-ts1s>2\times(ts1e-ts1p),$$

where $$\delta js1(t)=js1W(t)-js1B(t),$$

a state W is a state where a group comprising specified ones of said plurality of discharge cells is addressed to display a white image, a state B is a state where said group comprising specified ones of said plurality of discharge cells is set to display a black image, leaving the remainder of said plurality of discharge cells unchanged from said state W, js1W(t)=a current flowing into a first one of said pair of discharge-sustaining electrodes of said group in said state W, js1B(t)=a current flowing into said first one of said pair of discharge-sustaining electrodes of said group in said state B, said first one of said pair of discharge-sustaining electrodes is at a positive potential with respect to another of said pair of discharge-sustaining electrodes immediately after said interval of time, said currents are taken as positive when flowing into corresponding electrodes from a circuit external to said plasma display panel, t1a is a time at which an absolute value of a voltage difference between said pair of discharge-sustaining electrodes decreases to 0.9×V3 first after said S1 period during said light-emission period, S3 period is defined as a period from the time t1 to the time t1a, δjs1max is a maximum value of δjs1(t) during said S3 period, ts1p=an average of two times at which δjs1(t) reaches a value of 0.9×δjs1max first and last, respectively, during said S3 period, ts1s is a time at which δjs1(t) reaches 0.05×δjs1max first prior to the time ts1p during said S3 period, and ts1e is a time at which δjs1(t) reaches 0.05×δjs1max first after the time ts1p during said S3 period.

10. A method of driving a plasma display device including a plasma display panel having a plurality of discharge cells, each of said plurality of discharge cells being provided with a pair of first and second discharge-sustaining electrodes, an address electrode disposed to intersect said pair of first and second discharge-sustaining electrodes, and a dielectric substance covering said pair of first and second discharge-sustaining electrodes;

said method including at least address-discharge period for addressing said plurality of discharge cells and thereby inducing address-discharge therein; and light-emission period for applying repetitive discharge-sustaining pulse voltages to at least one of said pair of first and second discharge-sustaining electrodes such that said addressed ones of said plurality of discharge cells start and sustain main discharge depending upon the presence of said address-discharge to generate light for formation of a display, wherein an address voltage comprised of second repetitive pulse voltages is applied to said plurality of address electrodes to generate pre-discharge, said second repetitive pulse voltages changing in a positive direction during at least a portion of an interval of time, said pre-discharge initially occurring between said address electrodes of said addressed ones of said plurality of discharge cells and one of first and second said discharge-sustaining electrodes of said addressed ones, and thereafter occurring between said pair of first and second discharge-sustaining electrodes of said addressed ones, where t1≦said interval of time≦t2, V3 is a maximum of an absolute value of a voltage difference between said first and second discharge-sustaining electrodes during said light-emission period, S1 periods are each defined as periods which straddle respective valleys of a waveform of said absolute value of said voltage difference, and during which said absolute value of said voltage difference is less than or equal to 0.9×V3, t1 is a time at which each of said S1 periods starts, S2 periods are each defined as periods during which said absolute value of said voltage difference is less than or equal to 0.5×V3 within a respective one of said S1 periods, and t2 is a time at which each of said S2 periods ends.

11. A method of driving a plasma display device according to claim 10, wherein a voltage difference between maximum and minimum values of said address voltage during at least a portion of said interval of time is in a range from 20 V to 90 V.

12. A method of driving a plasma display device according to claim 10, wherein said address voltage changes in a negative direction after time thalf, where jsmax1 is a maximum of an absolute value of a current flowing into one of said pair of first and second discharge-sustaining electrodes during main discharge occurring in said interval of time or thereafter, jsmax2 is a maximum of an absolute value of a current flowing into another of said pair of first and second discharge-sustaining electrodes during said main discharge, jsmax is a larger one of jsmax1 and jsmax2, and thalf is a time at which said absolute value of the current flowing into one of said pair of first and second discharge-sustaining electrodes decreases to 0.5×jsmax, said one of said pair of first and second discharge-sustaining electrodes providing jsmax.

13. A method of driving a plasma display device according to claim 10, wherein the following relationship is satisfied during said light-emission period:

$$Vsaf+70\ V \geqq Vsum \geqq Vsaf,$$

where

Vsum is a sum of an absolute value of a voltage difference between maximum and minimum values of said discharge-sustaining voltages during said light-emission period and an absolute value of a voltage difference between maximum and minimum values of said address voltage during said light-emission period, and Vsaf is a voltage at which discharge starts between said address electrode and one of said pair of first and second discharge-sustaining electrodes.

14. A method of driving a plasma display device according to claim 10, wherein the following relationship is satisfied during said light-emission period:

$$Vabs \geqq \tfrac{2}{3} Vsf,$$

where

Vabs is an absolute value of a voltage difference between maximum and minimum values of said discharge-sustaining voltages, and Vsf is a voltage at which discharge starts between said pair of first and second discharge-sustaining electrodes.

15. A method of driving a plasma display device according to claim 10, wherein the following relationship is satisfied during said light-emission period:

$$\Delta Vs1 < \Delta Vs2 < \Delta Va,$$

where

Vs1s, Vs2s, and Vas are voltages applied to one of said pair of first and second discharge-sustaining electrodes, another of said pair of first and second discharge-sustaining electrodes, and said plurality of address electrodes, respectively, at a first period during which said pair of first and second discharge-sustaining electrodes have applied thereon voltages equal to one another, Vs1d, Vs2d, and Vad are voltages applied to said one of said pair of first and second discharge-sustaining electrodes, said another of said pair of first and second discharge-sustaining electrodes, and said plurality of address electrodes at a second period, respectively, prior to said first period, during which said pair of discharge-sustaining electrodes have applied thereon voltages different from each other, $\Delta Vs1$ is $Vs1s-Vs1d$, $\Delta Vs2$ is $Vs2s-Vs2d$, and $\Delta Va$ is $Vas-Vad$.

16. A plasma display device comprising:

a plasma display panel including a plurality of pairs of first and second discharge-sustaining electrodes, a plurality of address electrodes arranged to intersect said plurality of pairs of first and second discharge-sustaining electrodes, a dielectric substance covering said plurality of pairs of first and second discharge-sustaining electrodes, a plurality of discharge cells defined by said plurality of pairs of first and second discharge-sustaining electrodes and said plurality of address electrodes;

a pulse generating circuit having a voltage input terminal and a plurality of output terminals corresponding to said plurality of pairs of first and second discharge-sustaining electrodes and supplying pulses to said plurality of pairs of first and second discharge-sustaining electrodes for generating sustaining-discharge between said first and second discharge-sustaining electrodes, a driving circuit for selectively applying address-pulse voltages to said plurality of address electrodes of said plurality of discharge cells intended for formation of a display, and a control circuit for controlling pre-discharge pulse voltages such that said pre-discharge pulse voltages are applied to said plurality of address electrodes to generate pre-discharge for triggering said sustaining-discharge, said pre-discharge initially occurring between said address electrodes of said addressed ones of said plurality of discharge cells and one of said first and second discharge-sustaining electrodes of said addressed ones, and thereafter occurring between said first and second discharge-sustaining electrodes of said addressed ones, and said pre-discharge pulse voltages rise in portions of said light-emission period during which an absolute value of a voltage difference between said pair of first and second discharge-sustaining electrodes does not exceed 0.9×a maximum of an absolute value of a voltage difference between said pair of first and second discharge-sustaining electrodes during said light-emission period.

17. A plasma display device according to claim 16, wherein a portion of said driving circuit is also used during said light-emission period.

18. A plasma display device according to claim 16, wherein a portion of dc voltage supplies used in said driving circuit is also used during said light-emission period.

19. A plasma display device according to claim 16, wherein said plurality of address electrodes are coupled to one of a fixed potential and a ground potential via an integrated circuit including a plurality of switching elements for generating said address-pulse voltages, and an inductance element is coupled between said integrated circuit and said one of the fixed potential and the ground potential.

20. A plasma display device according to claim 17, wherein said plurality of address electrodes are coupled to one of a fixed potential and a ground potential via an integrated circuit including a plurality of switching elements for generating said address-pulse voltages, and an inductance element is coupled between said integrated circuit and said one of the fixed potential and the ground potential.

21. A plasma display device according to claim 18, wherein said plurality of address electrodes are coupled to one of a fixed potential and a ground potential via an integrated circuit including a plurality of switching elements for generating said address-pulse voltages, and an inductance element is coupled between said integrated circuit and said one of the fixed potential and the ground potential.

* * * * *